US006988653B2

(12) United States Patent
Bell

(10) Patent No.: US 6,988,653 B2
(45) Date of Patent: Jan. 24, 2006

(54) FOLDABLE CARTON

(76) Inventor: Matthew Colin Bell, 30 Snowdonia Court, Ballajura, Western Australia (AU) 6006

( * ) Notice: Subject to any disclaimer, the term of this patent is extended or adjusted under 35 U.S.C. 154(b) by 0 days.

(21) Appl. No.: 10/230,385

(22) Filed: Aug. 28, 2002

(65) Prior Publication Data

US 2003/0080179 A1 May 1, 2003

Related U.S. Application Data

(63) Continuation-in-part of application No. 09/762,095, filed as application No. PCT/AU99/00632 on Aug. 4, 1999, now abandoned.

(30) Foreign Application Priority Data

Aug. 4, 1998 (AU) ..... PP5037

(51) Int. Cl.
*B65D 5/36* (2006.01)

(52) U.S. Cl. ..... 229/117.05; 229/140

(58) Field of Classification Search ..... 229/140, 229/137, 138, 117.05, 104, 186
See application file for complete search history.

(56) References Cited

U.S. PATENT DOCUMENTS

| | | | | | |
|---|---|---|---|---|---|
| 715,026 | A | * | 12/1902 | Crawford | 229/117.27 |
| 1,611,029 | A | * | 12/1926 | Hedstrom | 229/117.27 |
| 2,281,165 | A | * | 4/1942 | Miller | 229/117.27 |
| 2,379,665 | A | * | 7/1945 | Stone | 229/117.27 |
| 2,701,091 | A | * | 2/1955 | Sullivan | 229/103.2 |
| 3,269,637 | A | * | 8/1966 | Whittaker | 229/117.27 |
| 4,471,904 | A | * | 9/1984 | Cassidy | 229/117.27 |
| 5,413,273 | A | * | 5/1995 | Money | 229/128 |

* cited by examiner

*Primary Examiner*—Tri M. Mai
(74) *Attorney, Agent, or Firm*—Blank Rome LLP

(57) ABSTRACT

A collapsible carton which is formed from a single cardboard blank which when formed from the blank is capable of being folded between a folded flat condition and an erect condition whereby when in the erect condition the carton has a floor (11) and four side panels (12, 13, 14 and 15) to define a generally rectangular prismatic shaped space, wherein the floor panel is formed of a single panel and the junction between the floor and each of the side panels is defined by a closed fold line therebetween, a pair of opposed first side panels (12 and 13) having a pair of diagonal fold lines (21 and 22), extending from the junction between the sides of the floor and the sides of the respective first side panel and converging to terminate at a transverse central axis of the first side panel said diagonals being substantially perpendicular to each other.

6 Claims, 26 Drawing Sheets

FOLDABLE CARTON

CROSS-REFERENCE TO RELATED APPLICATIONS

This application is a continuation-in-part of U.S. patent application Ser. No. 09/762,095, now abandoned, filed on Feb. 2, 2001 which is a 371 of PCT/AU99/00632 filed Aug. 4, 1999, which claims priority from Australian Provisional Application No. PP 5037 filed on Aug. 4, 1998.

BACKGROUND OF THE INVENTION

1. The Field of the Invention

This invention relates to collapsible packaging such as cartons and the like which are generally formed from blanks formed from a substantially rigid sheet material whereby the blanks are folded to form a carton.

2. The Relevant Technology

The cartons to which the invention relates are used in a wide variety of circumstances and one particular example of the application of the cartons relates to the forms of packaging used with take-away food items. It is a common characteristic of such cartons that they are not capable of accommodating liquid contents without the utilisation of a supplementary containment means. As a result, in the event of any spillage within the carton the liquid contents of the carton will leak and can create an undesirable circumstance for customers.

In the past, attempts have been made to provide cartons which can to some degree overcome this problem. One example of such a carton is disclosed in U.S. Pat. No. 4,471,904 which provides a carton whereby the floor is held in a raised position from the lower limit of the carton. However, in order for the carton to be foldable there is no closed junction between the floor panel and the end and side panels. As a result, there is still the likelihood of leakage therebetween. A further example comprises that which is disclosed in U.S. Pat. No. 2,430,755. However, the carton disclosed in that specification is not one that which is capable of being folded and providing a closed junction between the floor and the side panels.

It is desirable to provide a carton which when assembled from a blank can be folded to lie in a substantially flat condition and which can be readily unfolded into an erect condition whereby when in the erect condition no further action or containment means need be provided in order to prevent the leakage of the contents of the carton escaping from the base of the carton.

SUMMARY OF THE INVENTION

Accordingly the invention resides in a collapsible carton which is formed from a blank which when formed from the blank is capable of being folded between a folded flat condition and an erect condition whereby when in the erect condition the carton has a floor, two opposed end panels and two opposed side panels to define a liquid tight generally rectangular closed prismatic shaped space, the end panels and the side panels having substantially the same height wherein the floor panel is formed of a single panel and the junction between the floor and each of the end panels and each of the side panel is defined by a closed fold line therebetween, the end panels each having a pair of first diagonal fold lines extending from the junction between the sides of the floor and the sides of the respective end panel and converging to terminate at a transverse central axis of the end panel, said first diagonal fold lines being substantially perpendicular to each other, said end panels have a height being equal to or greater than the termination of the diagonals, wherein the floor is provided with a first central fold line which is substantially centrally located and which extends between the end panels and is adapted to permit the floor to fold inwardly into the space about the first central fold line while the first diagonal fold lines fold, said end panels being provided with a second central fold line extending centrally from the floor to an opposed edge of the end panel, each end panel and each side panel formed with an extension panel, said extension panels being of substantially the same height and being hingedly supported from their respective end or side panel, wherein in the erected carton the abutting edges of adjacent extension panels are defined by a closed fold line, the extension panel of each end panel being formed with a pair of second diagonal fold lines extending between the junction between the end panel and the extension panel at the sides thereof and converging to terminate at the junction of the second fold line with the outer edge of the extension panel, whereby on the erection of the carton the extension panels of each end panel fold about the second diagonal fold lines and the junction with the end panels to an intermediate position where the extension panels of the side panels fold over the space to close the space and lie parallel to said floor panel, the extension panels of the end panels being further foldable about their junction with their respective end panels to lie in a self locked position parallel to and adjacent their respective end panels on an outside of said space at which self locked position a biasing force is applied to the extension panels of the end panels in a direction of their respective end panels.

Preferably when in the erect condition said floor panel and said junction between floor panel and each of said end panels and side panels lie on a common plane.

According to a preferred feature of the invention the termination of the diagonals defines the height of the side panel.

According to a preferred feature of tile invention the carton is formed from a blank where the end and side panels are each hingedly supported from the edge of the floor through a fold line.

According to a preferred feature of the above feature in the blank the adjacent sides of adjacent end and side panels are interconnected by a web having an edge which is substantially at 45° to the adjacent edges of the adjacent end and side panels and which has a further diagonal fold line extending from the junction of the adjacent end and side panels which bisects the angle therebetween.

According to a preferred feature of the invention in the blank the side panels are hingedly supported from the floor and the end panels are hingedly supported from the side panels.

According to a further preferred feature of the previous feature in the blank one end panel is supported from one of the side panels and the other end panel is supported from the other side panel.

According to an alternative preferred feature of the previous feature in the blank each side panel supports a portion of an end panel whereby the portions of the end panels co-operate to define the end panels when the blank is folded to an erect condition, According to each preferred feature of the invention wherein in the blank at least one of a pair of edges of the end and side panels which are to become interengaged when the carton is formed are provided with glue flaps.

The invention will be more fully understood in the light of the following description of several specific embodiments.

BRIEF DESCRIPTION OF THE DRAWINGS

The description is made with reference to the accompanying drawings of which.

BEST MODES FOR CARRYING OUT THE INVENTION

Each of the embodiments are directed to cartons which are formed from a stiff sheet material such as cardboard where the sheet material is formed into a blank and which can be folded to form a carton whereby when the carton has been formed it can be readily folded into a substantially flat condition and can be subsequently erected from the folded flat condition to provide a carton defining a liquid tight generally rectangular prismatic shaped space whereby the junctions between the floor panel and the side panels and end panels and the junctions between the end panels and the side panels are closed and are resistant to the leakage of the contents. In forming the carton from the blank the formed carton may initially take the form of the folded carton which can then be erected into the carton when it is required. Alternatively in forming the carton from the blank it may initially take the form of the erected carton to be then capable of being folded into a substantially flat condition for transportation and/or storage and subsequent unfolding into an erected carton when required.

A significant feature of each of the embodiments relates to the closure of the cartons. This is achieved through extension panels to each of the side panels and end panels where the extension panels have substantially the same height and adjacent extension panels are interconnected at the adjacent edges. The extension panels on each of the end panels are capable of folding about the junction with the respective end panel and about diagonal fold lines in the extension panel. This will result in the folded extension panel extending laterally from the respective end panel and as a further result the extension panels on the side panels will have been caused to have hinged about their junction with the respective side panel to overlie the space defined by the carton. It has been found that because of the construction of the carton where end panels, the side panels and the floor panel are all closed or fully joined (i.e. formed without any discontinuities such as holes, slots or openings) that, on hinging the folded extension panel about its junction with the respective end panel to a position (locked position) parallel and alongside the end panel, a biasing force is applied to the folded extension panel causing it to move towards the end panel and thus be retained at that locked position. Without wishing to be bound by theory, this bias force is believed to arise from tension within the panels created due to the junctions of the panels being closed or filly joined.

Figure 1:
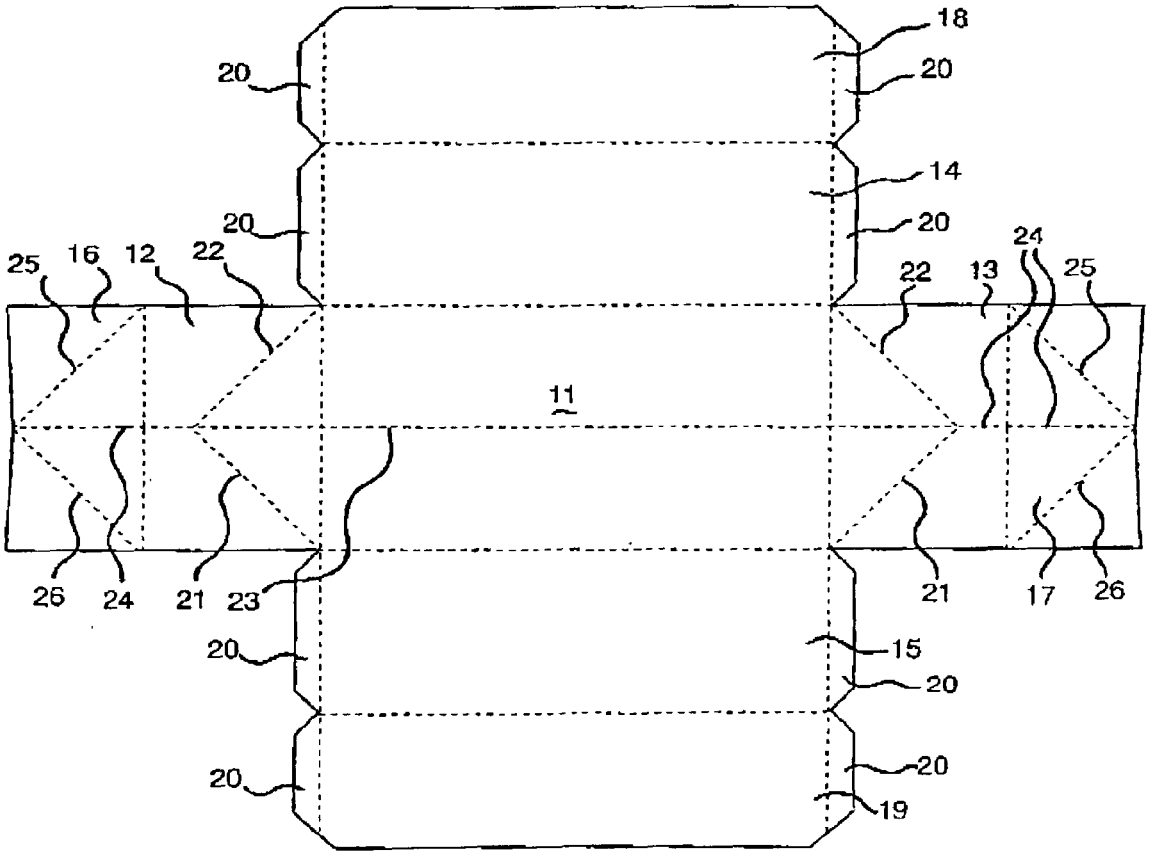
FIG. 1 is a plan view of a blank according to the first embodiment.

The first embodiment as shown at FIGS. 1, 2, 3, 4, 5 and 6 comprises a carton which is formed of a blank shown at FIG. 1 where the carton has a floor panel 11, two end panels 12 and 13 and two side panels 14 and 15. Each of the end panels 12 and 13 and each of the side panels 14 and 15 are provided with an outer extension panel 16, 17, 18 and 19 respectively which when the carton is erected combine to provide the closure for the carton. Each of the end panels 12 and 13 and the side panels 14 and 15 are formed integrally with the floor panel 11 and are connected to the floor panel 11 by a fold line whereby they can be folded to be substantially perpendicular to the floor panel 11 which will bring their adjacent side edges into abutment with each other.

The side edges of the side panels 14 and 15 and their extension panels 18 and 19 are provided with glue flaps 20 which are adapted to be able to overlie the edge portions of the inner faces of the adjacent end panels 12 and 13 and their respective extension panels 16 and 17 when the side panels and end panels are folded along their fold line with the floor panel 11 as described above. The glue flaps 20 may be rendered self adherent such that they will adhere to the edge portions of end panels 12 or 13 or may have an adhesive applied thereto prior to folding to effect such adhesion. As a result of the fixing of the glue flaps 20 to the end panels 12 and 13 and their respective extension panels 16 and 17 the junctions between the end panels 12 and 13 and the side panels 14 and 15 and between the respective extension panels are sealingly closed.

Each of the end panels 12 and 13 are provided with a pair of first diagonal fold lines 21 and 22 which extend from the junction between the adjacent edges of the end panel and the adjacent side panel and terminate at the central axis of the end panel whereby the diagonal fold lines 21 and 22 are perpendicular to each other.

In addition in the case of the first embodiment the floor panel 11 is provided with a first central fold line 23 which is centrally located and extends between the end panels 12 and 13. Each of the end panels 12 and 13 and the respective extension panels 16 and 17 are formed with a second central fold line 24 which is co-linear in the folded blank shown in FIG. 1 with the first central fold line of the floor panel 11.

In addition each of the extension panels 16 and 17 on the end panels 12 and 13 are provided with a pair of second diagonal fold lines 25 and 26 which are parallel to the first diagonal fold lines 21 and 22. The second diagonal fold lines 25 and 26 extend from the junction between the respective end panel and the extension panel to converge and terminate at the outer edge of the extension panel.

Figure 2:
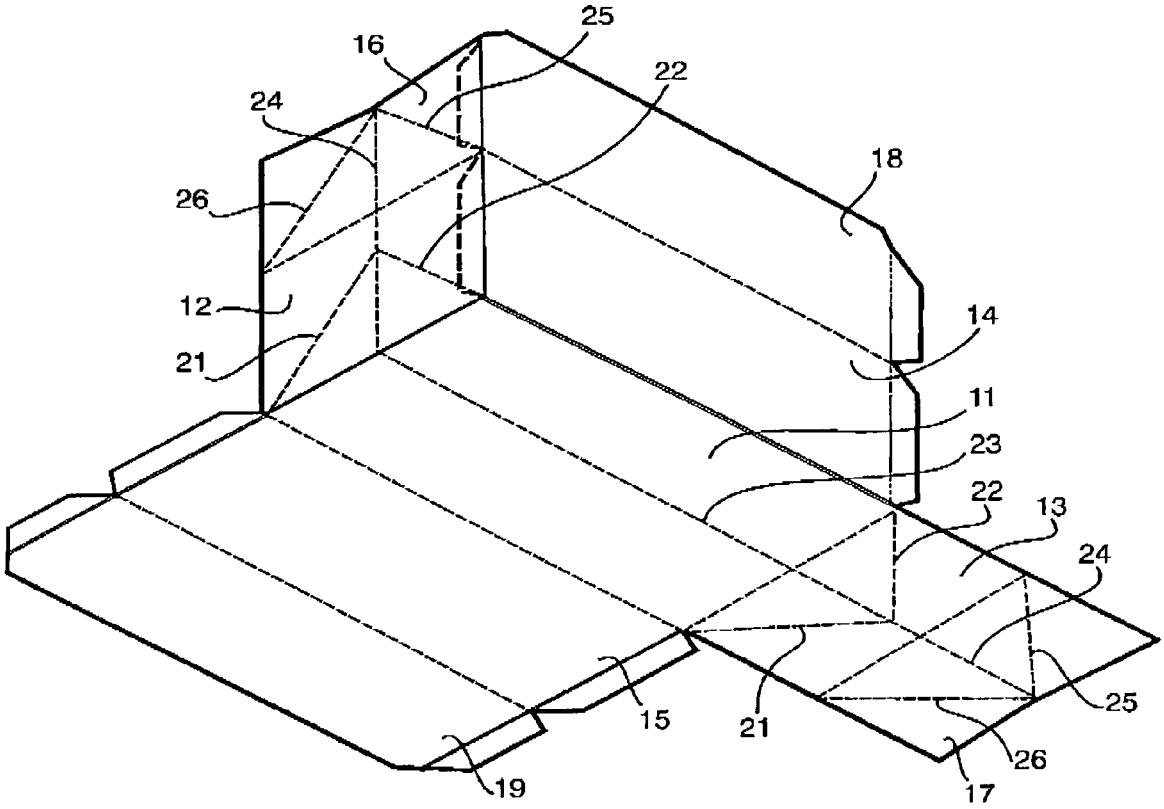
FIG. 2 is an isometric view of a partially folded blank according to the first embodiment.
Figure 3:
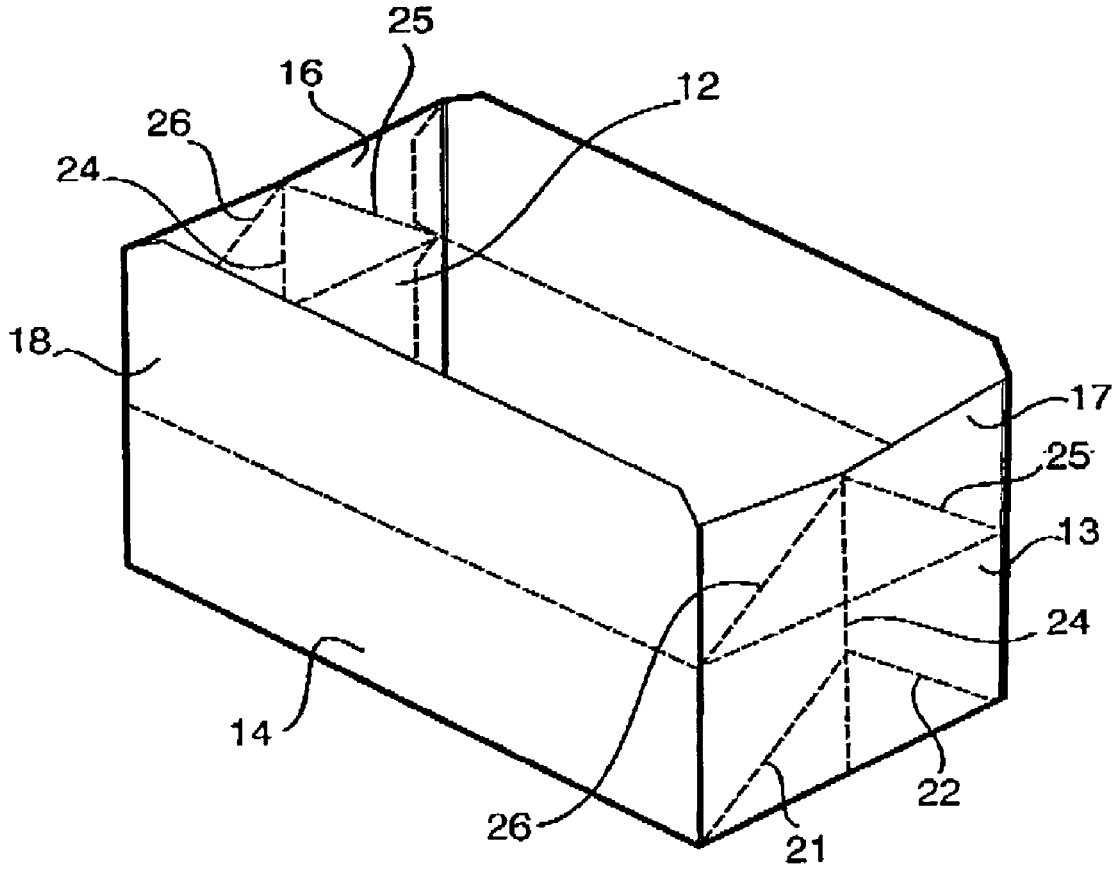
FIG. 3 is an isometric view of an erected carton formed from the blank of the first embodiment with the extension panels open.

In the formation of the carton from the blank, the side panels 14 and 15 and the end panels 12 and 13 are folded to be substantially perpendicular to the floor panel 11 which brings the glue flaps 20 into face to face engagement with the adjacent edge portions of the inner faces of respective end panels 12 and 13 and their extension panels 16 and 17. FIG. 2 illustrates the carton partially erected where one end panel 12 and its extension panel 16 has been folded with the adjacent side panel 14 and its extension panel 18 to be perpendicular to the floor panel 11. The glue flaps 20 on the side panels 14 and 15 and their extension panels 18 and 19 are then bonded to the respective end panels 12 and 13 and their extension panels 16 and 17 to define a substantially cubic carton as shown at FIG. 3 where the extension panels 16, 17, 18 and 19 are open. Once erected the side panels, end panels and floor panel of the formed carton define a liquid tight space whereby the folded junctions between the floor panel and each of the side panels and end panel is substantially continuous and is closed and the junctions between the side panels and the end panels are also continuous and sealed.

Figure 6:
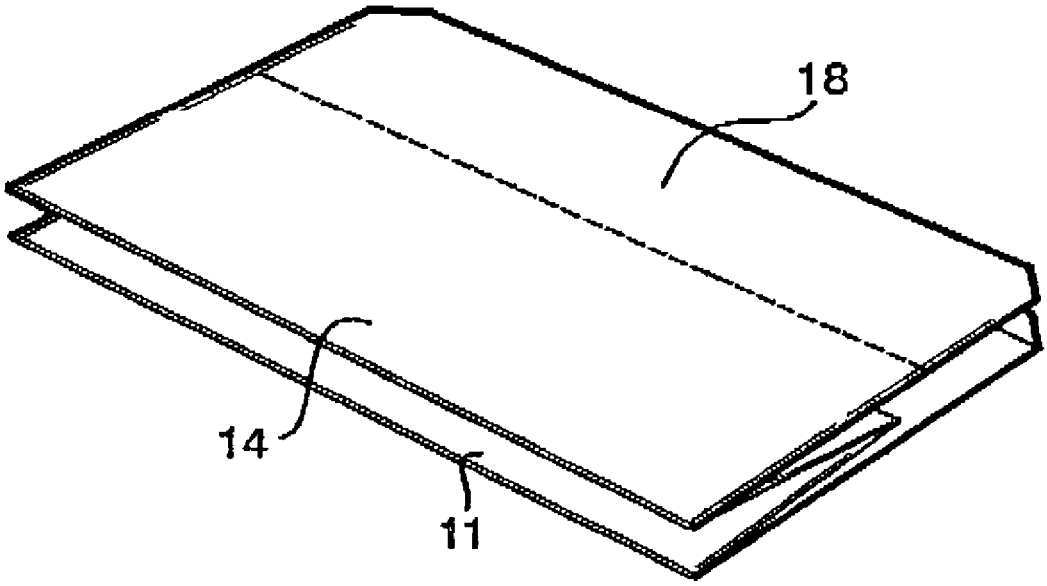
FIG. 6 is an isometric view of a folded carton formed of a blank according to the first embodiment.
Figure 7:
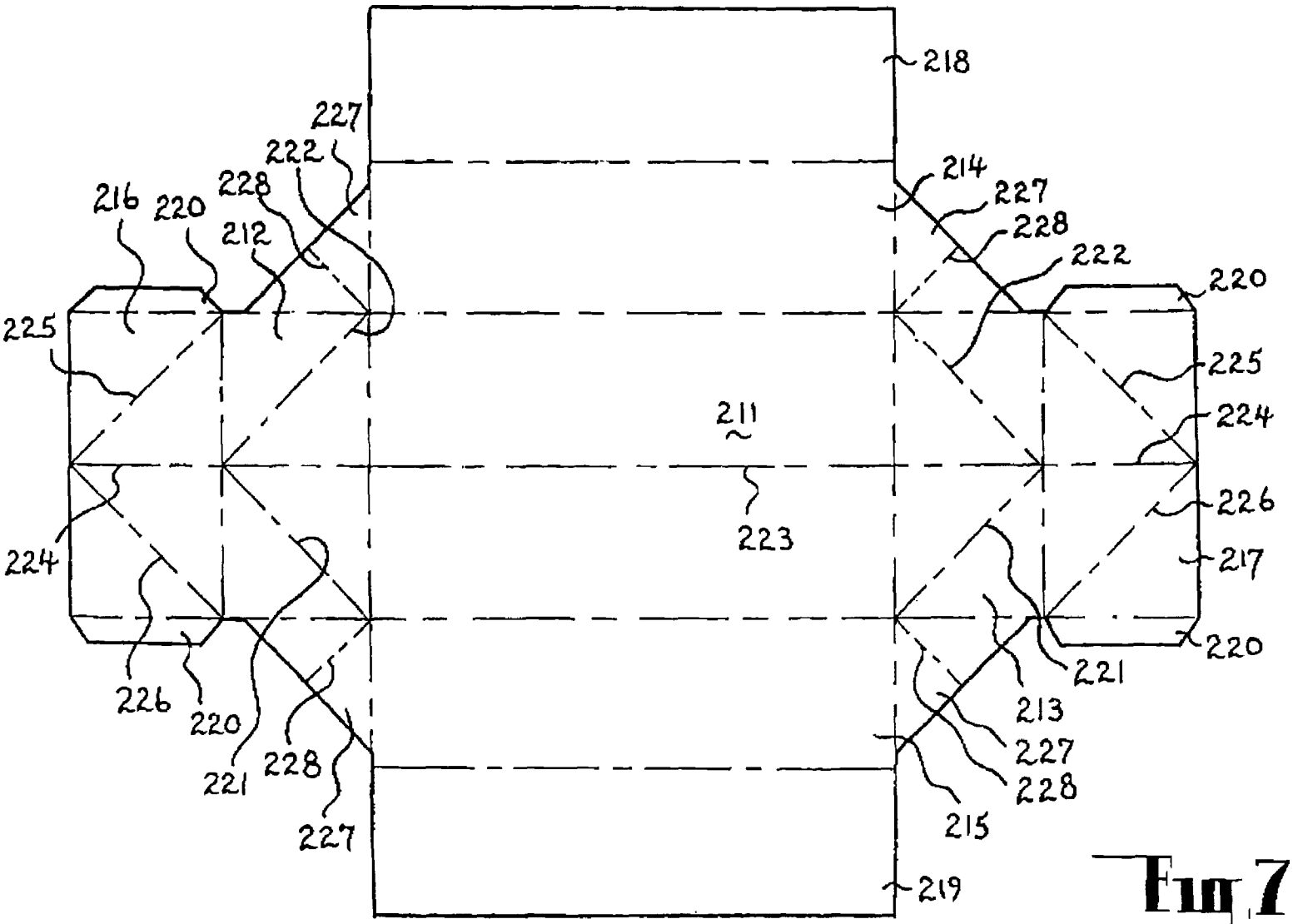
FIG. 7 is a plan view of a blank according to the second embodiment.

Furthermore, the carton can be readily folded to a substantially flat condition as shown at FIG. 6. This is effected by causing the first central fold line 23 of the floor panel 11 to fold such that the first central fold line 23 moves inwardly. In addition the first diagonal fold lines 21 and 22 of each of the end panels to move inwardly to lie between the side panels 14 and 15 to overlie the portions of the floor panel 11 to each side of the first central fold line 23 and the portion of the second central fold line 24 between the junction of the first diagonal fold lines 21 and the junction between the respective end panel 12 and 13 and the floor panel 11 moves to overlie the first central fold line 23. In addition the portion of the second central fold line 24 between the junction of the first diagonal fold line 21 and the outer edge of the extension panel 16 and 17 folds such that it moves inwardly to lie between the side panels 14 and 15. This action brings the side panels together with the folded floor panel 11 and folded end panels 16 and 17 located there between as shown at FIG. 6.

Figure 4:
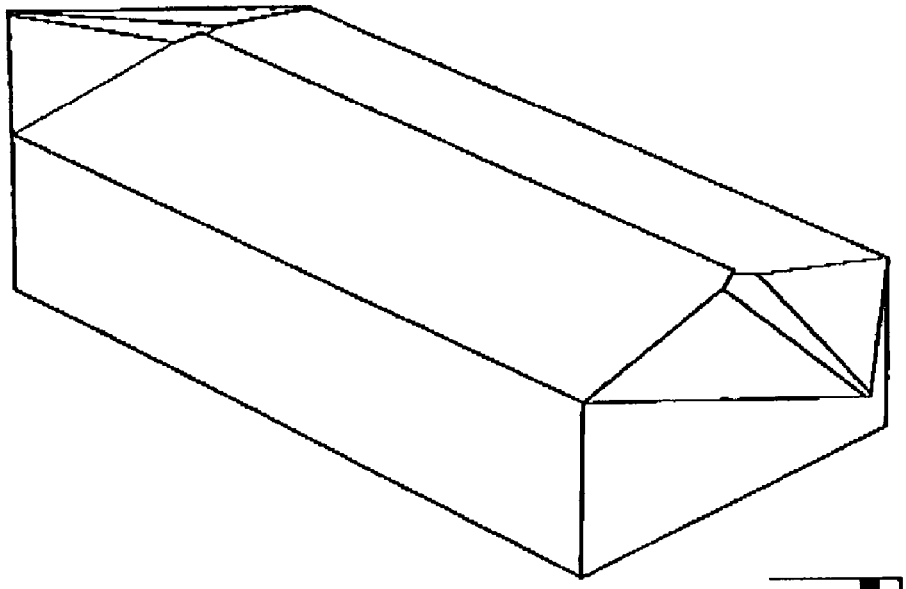
FIG. 4 is an isometric view of an erected carton formed from the blank of the first embodiment with the extension panels partially closed.
Figure 5:
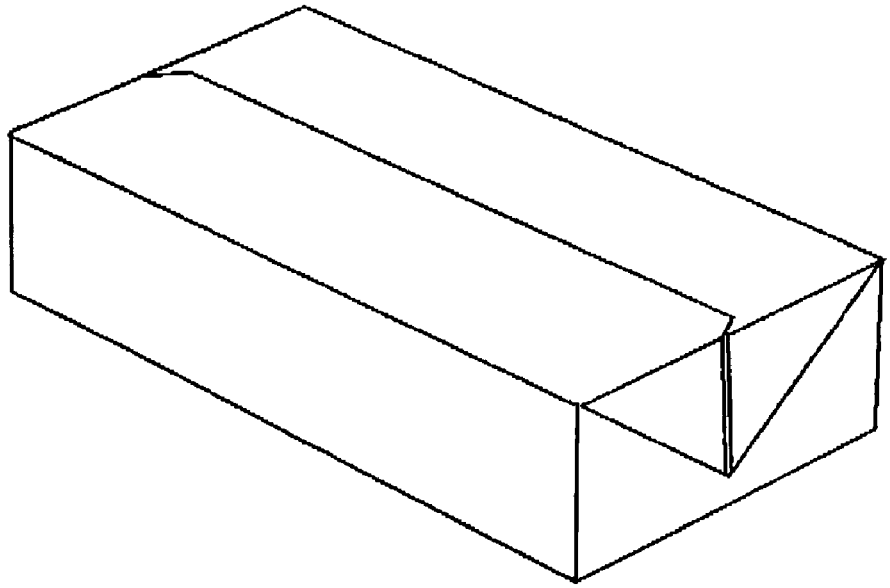
FIG. 5 is an isometric view of an erected carton formed from the blank of the first embodiment with the extension panels fully closed.

When the carton is in the erected condition as shown at FIG. 3 the carton can be closed by causing the second diagonal fold lines to fold such that the inner faces of the extensions 17 and 16 end panels to each side of the second diagonal fold lines 25 and 26 fold inwardly about the second diagonal fold lines towards each other as shown at FIG. 4. As a result the extensions 17 and 16 of the end panels fold outward from each end of the carton which serves to bring the extensions 18 and 19 on the side panels 14 and 15 towards each other to overlie the space created by the carton between the floor panel, the side panels and the end panels. The folded extensions of the end panels can ten be folded downwardly about the fold line defined between the junction of each end panel 12 and 13 and its respective extension 16 and 17 whereby the folded extension lies closely adjacent and substantially parallel to the outer face of the respective end panel as shown at FIG. 5. Also the floor panel 11 and the junctions of the floor panel 11 and the end and side panels panels 12, 13, 14 and 15 lie on a common plane.

It has been found that because of the construction of the carton where end panels, the side panels and the floor panel are all fixed together and are closed (i.e. formed without any holes, slots or openings) that on attempting to hinge the folded extension panels 16 and 17 about their junctions with the respective end panels 12 and 13 from the lateral position as shown at FIG. 4 to a locked position parallel and alongside the end panels as shown at FIG. 5, an initial biasing force is generated by the carton and applied to the folded extension panel as it moves to the locked position resisting its movement to the locked position. However, at an intermediate stage of that movement the initial force is replaced by a contrary biasing force generated by the carton which causes the folded extension panel to move towards the end panel and thus be retained at the locked position. To move the folded extensions from the locked position requires the external application of sufficient force to counteract the contrary biasing force. Thus the carton 10 can be closed and retained in the closed condition without the application of any other means or action. Indeed this provides a "snap" lock facility where the carton snap closes and is self held in a closed condition after folding the extension panels 16 and 17 through an intermediate angle below their lateral (horizontal) positions.

In the case of the second embodiment as shown at FIGS. 7 to 11 the carton is of a generally similar form to that of the first embodiment with the exception that in the case of the side panels 214 and 215 the edges are not provided with glue flaps but rather the edges of the end panels 212 and 213 are interconnected with the adjacent edges of the adjacent side panels 214 and 215 by a web element 227 which has an outer edge which is disposed at substantially 45° to the edges of the respective end panel and side panel. In addition the webs

227 are each provided with a third diagonal fold line 228 which extends from the junction between the adjacent edges of the adjacent end panel and side panel where the third diagonal fold line 228 bisects the angle between the adjacent end panel and side panel.

In addition the side edges of the extensions 216 and 217 of the end panels 212 and 213 are provided with glue flaps 220 which are adapted to be able to overlie the edge portions of the inner faces of the adjacent extension panels 218 and 219 of the side panels 214 and 215 when the side panels and end panels are folded along their fold line with the floor panel 211. The glue flaps 220 may be rendered self adherent such that they will adhere to the edge portions of extension panels 218 and 219 of the side panels 214 and 215 or may have an adhesive applied thereto prior to folding to effect such adhesion. As a result of the fixing of the glue flaps 220 to the extension panels 218 and 219 the junctions between the extension panels on the side panels 214 and 215 and the end panels 212 and 213 are sealingly closed.

Figure 8:
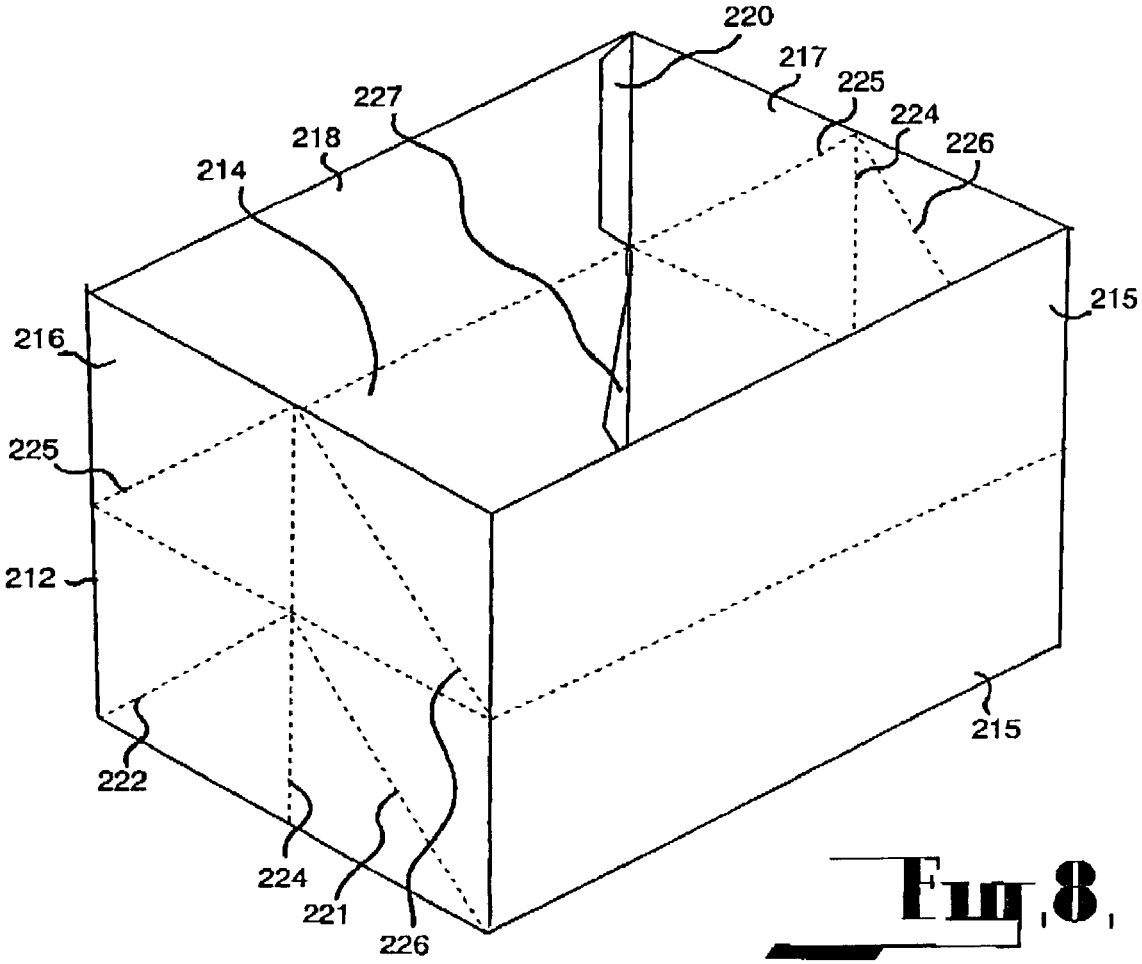
FIG. 8 is an isometric view of an erected carton formed from a blank of the second embodiment with the extension panels open.

In folding the blank to form the erected carton as shown in FIG. 8 each web 227 is folded about the junction between the respective end panel and side panel and the third diagonal fold line 228 is caused to fold and move inwardly such that the web is folded and lies within the carton adjacent the respective side wall, to be bonded thereto.

Figure 9:
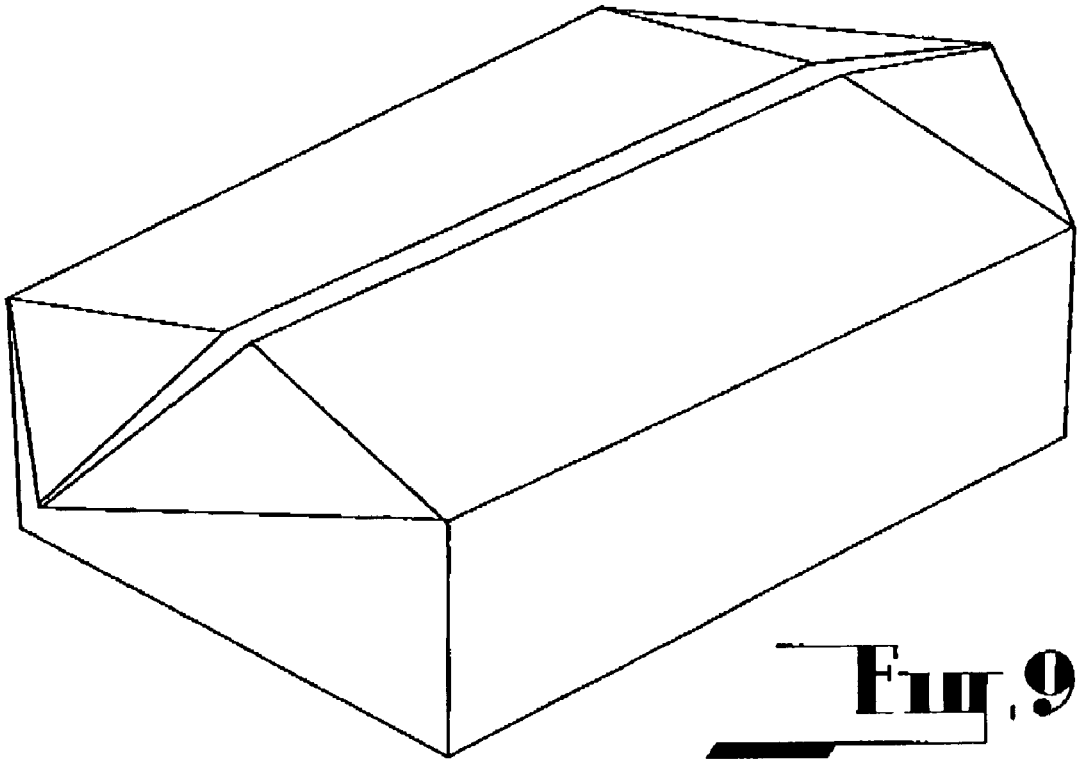
FIG. 9 is an isometric view of an erected carton formed from the blank of the second embodiment with the extension panels partially closed.
Figure 10:
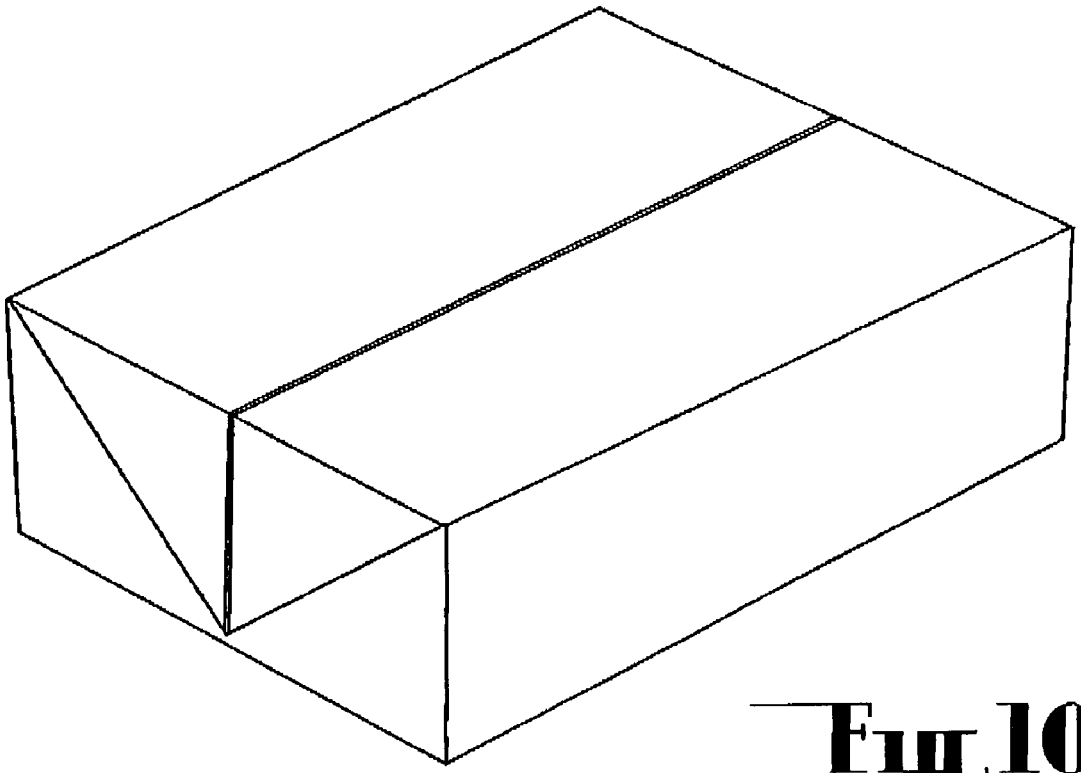
FIG. 10 is an isometric view of an erected carton formed from the blank of the second embodiment with the extension panels fully closed.
Figure 11:
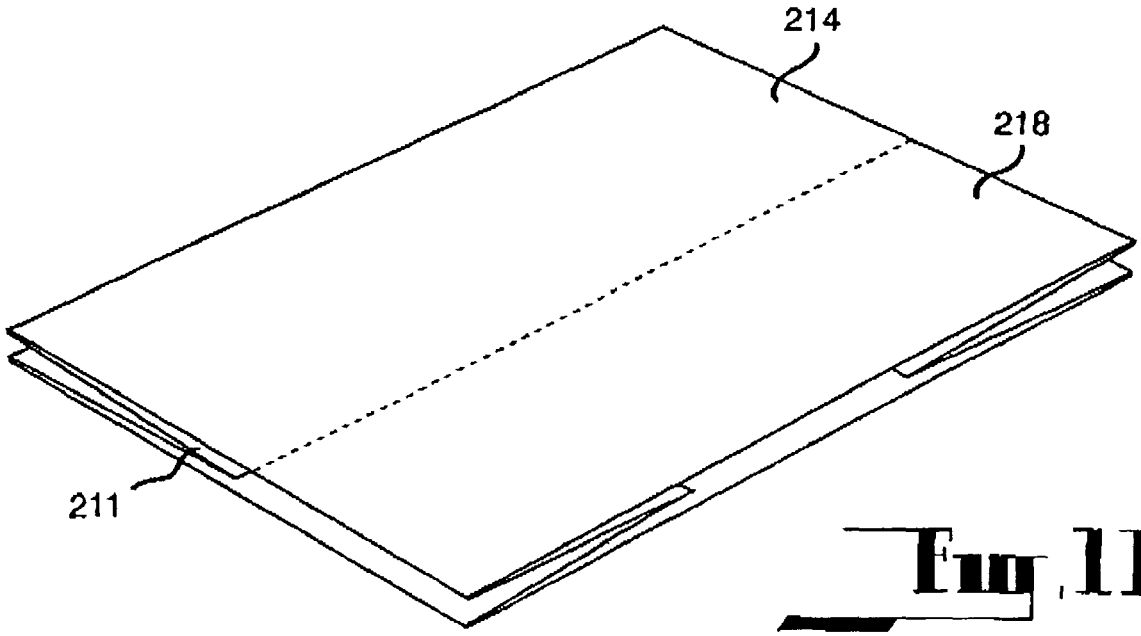
FIG. 11 is an isometric view of a folded carton formed from a blank of the second embodiment.
Figure 12:
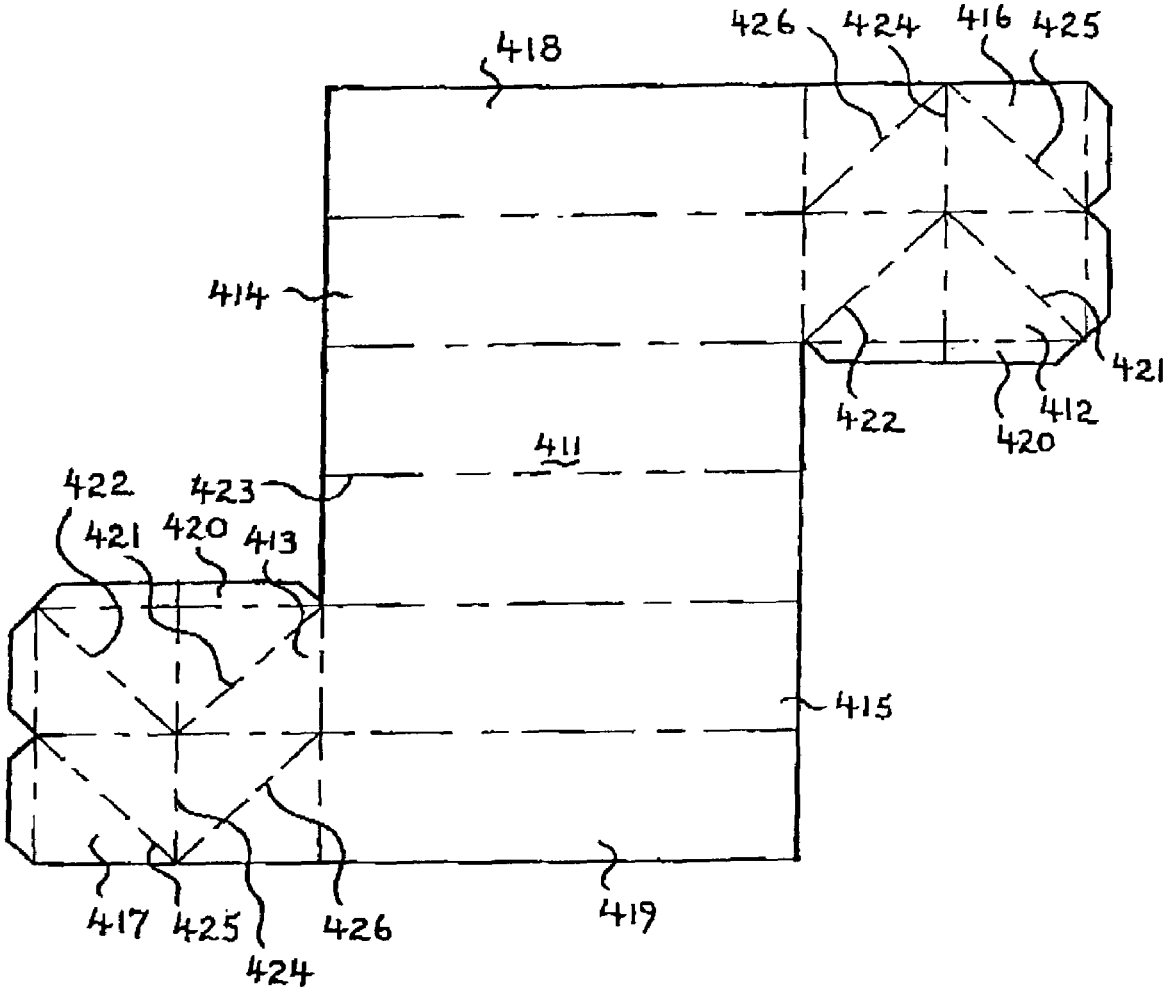
FIG. 12 is a plan view of a blank according to the third embodiment.

The erected carton can then be folded into flat condition as shown at FIG. 11 in the same manner as has been described in relation to the first embodiment. In addition the erected carton can be closed in the same manner as has been described in relation to the first embodiment and as shown at FIGS. 9 and 10 with the same locking action as described in relation to the first embodiment.

Figure 13:
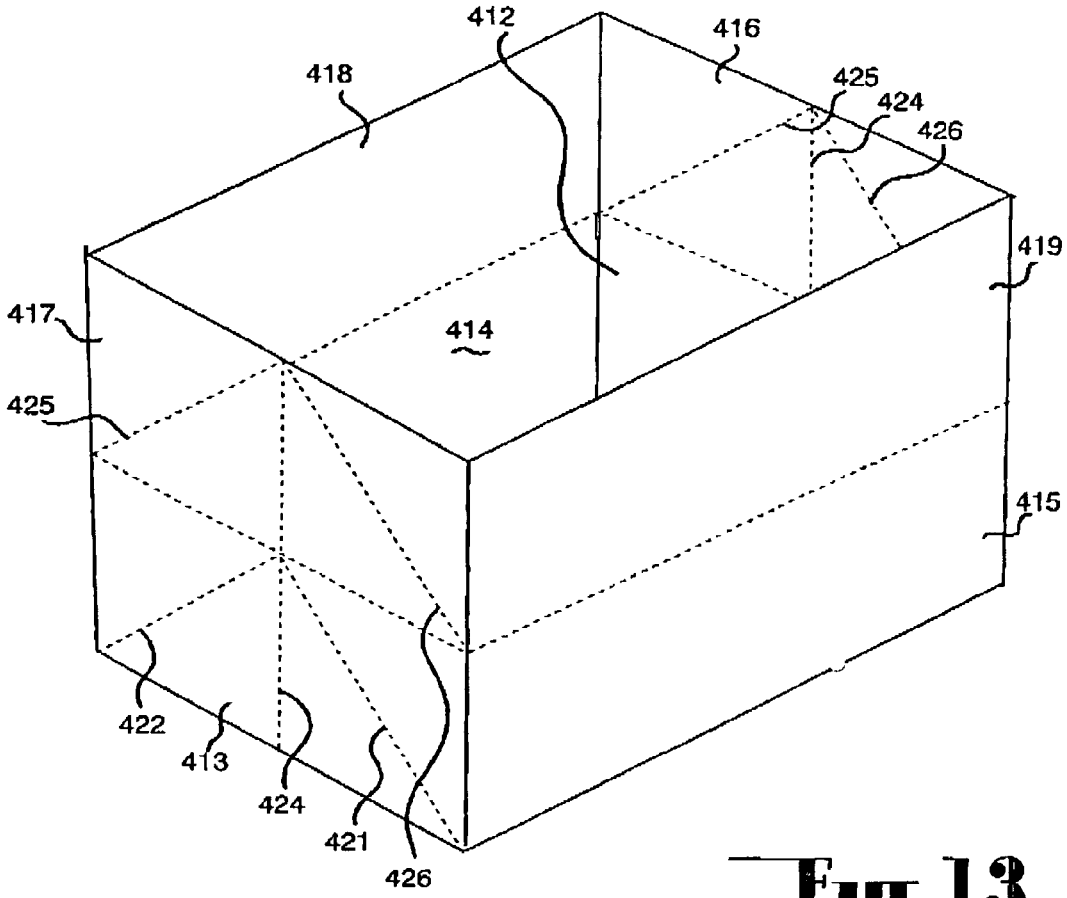
FIG. 13 is an isometric view of an erected carton formed using the blank of the third embodiment with the extension panels open.
Figure 14:
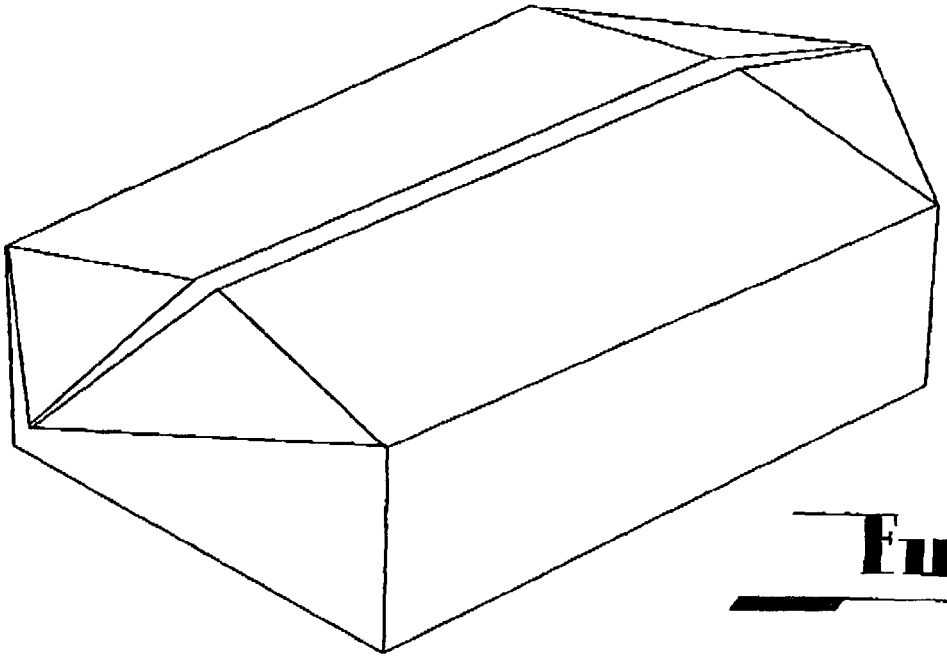
FIG. 14 is an isometric view of an erected carton formed from the blank of the third embodiment with the extension panels partially closed.
Figure 15:
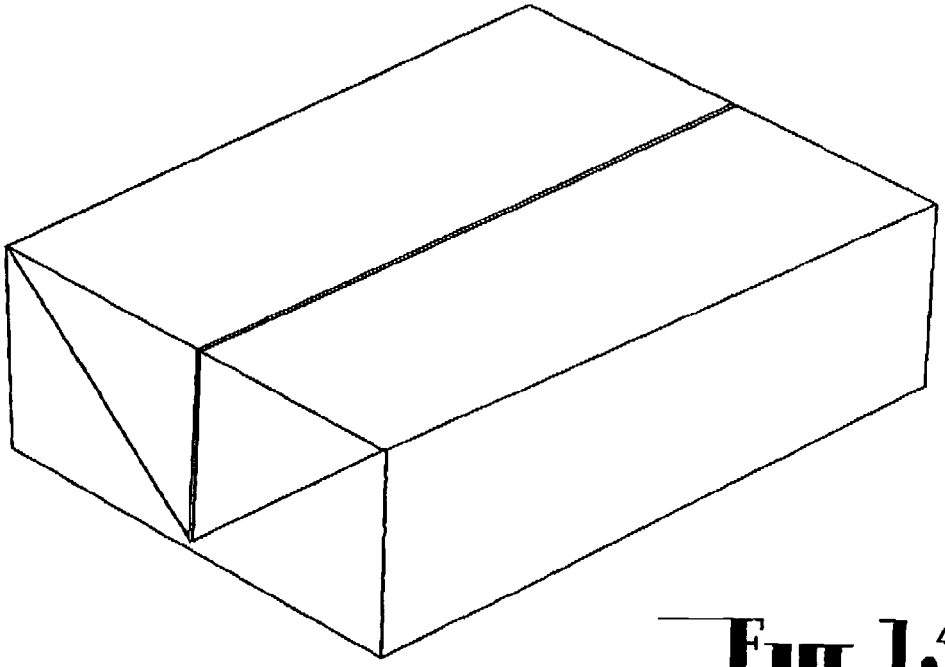
FIG. 15 is an isometric view of an erected carton formed from the blank of the third embodiment with the extension panels fully closed.
Figure 16:
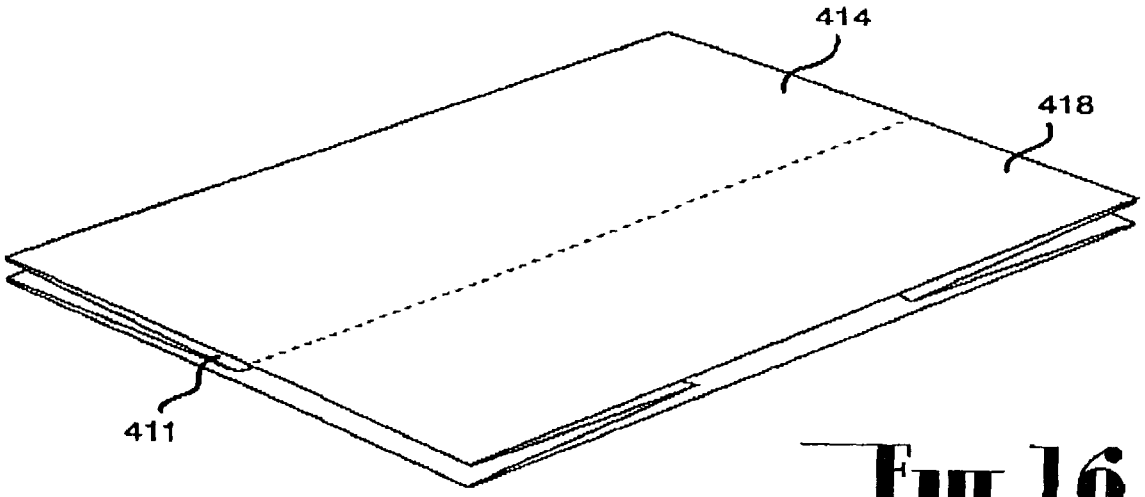
FIG. 16 is an isometric view of a folded carton formed from the blank of the third embodiment.
Figure 17:
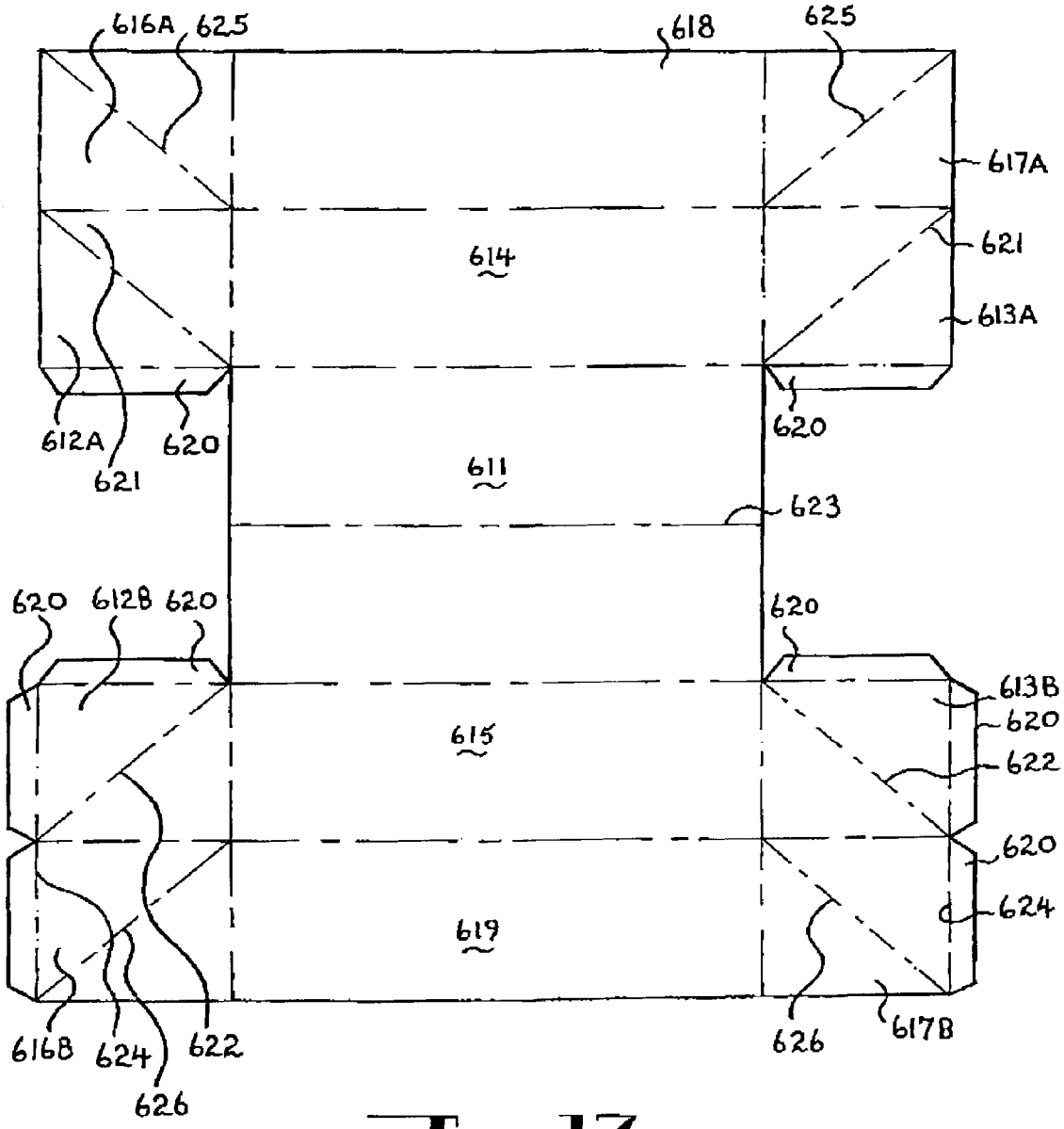
FIG. 17 is a plan view of a blank according to the fourth embodiment.

The third embodiment as shown at FIGS. 12 to 16 is of generally similar form to the first and second embodiment in terms of the configuration of the erected carton as shown at FIG. 13. The difference in relation to the third embodiment relates to the configuration of the blank as shown at FIG. 13 in that the end panels 412 and 413 are interconnected with one or the other side panel 418 or 419 respectively. When the carton has been formed from the blank as shown at FIG. 13 it can be folded and collapsed in a similar manner to that of the first and second embodiment as shown at FIG. 16 and can be closed in a similar manner to that of the first and second embodiment as shown at FIGS. 14 and 15 with the same locking action as described in relation to the first embodiment.

Figure 18:
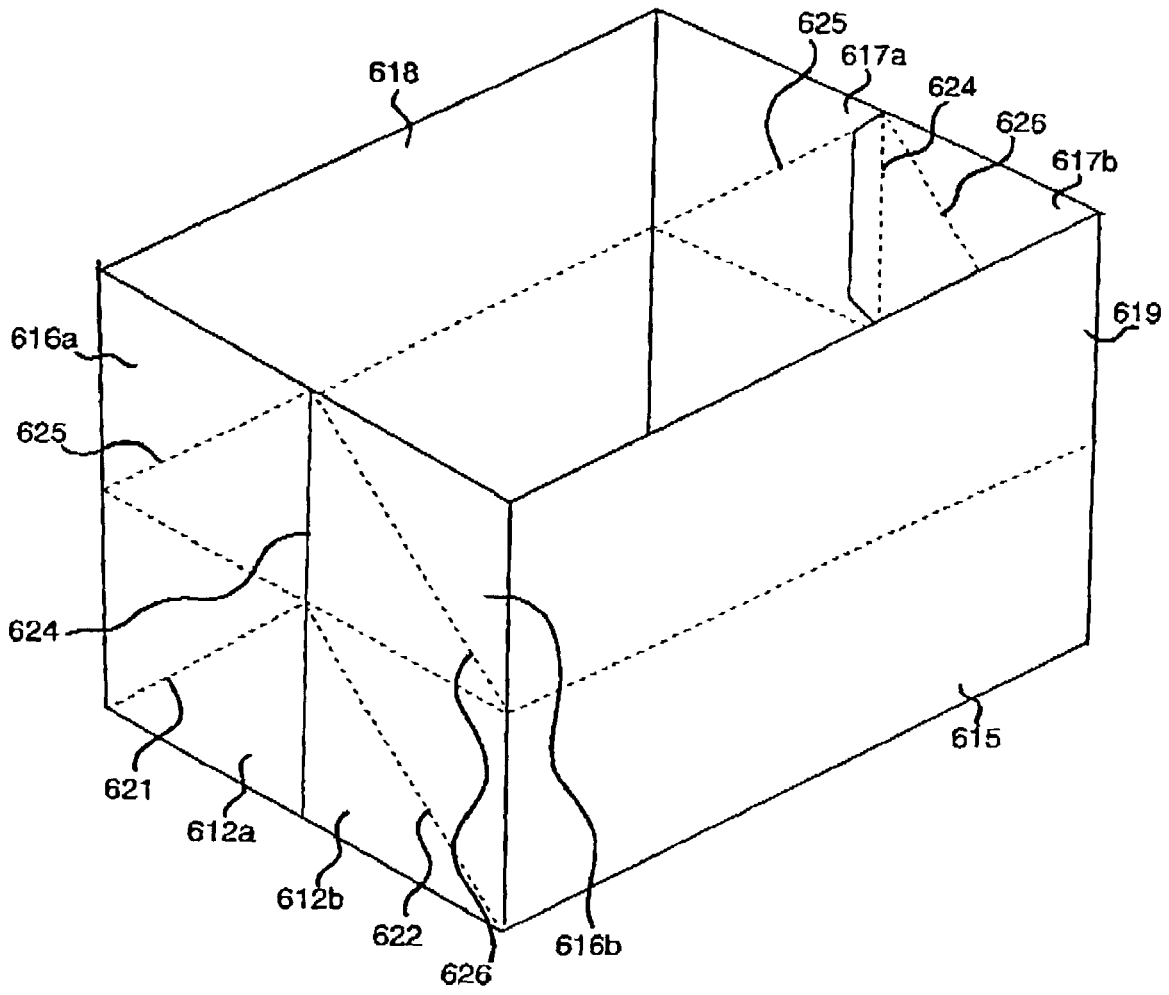
FIG. 18 is an isometric view of an erected carton formed from a blank according to the fourth embodiment with the extension panels open.
Figure 19:
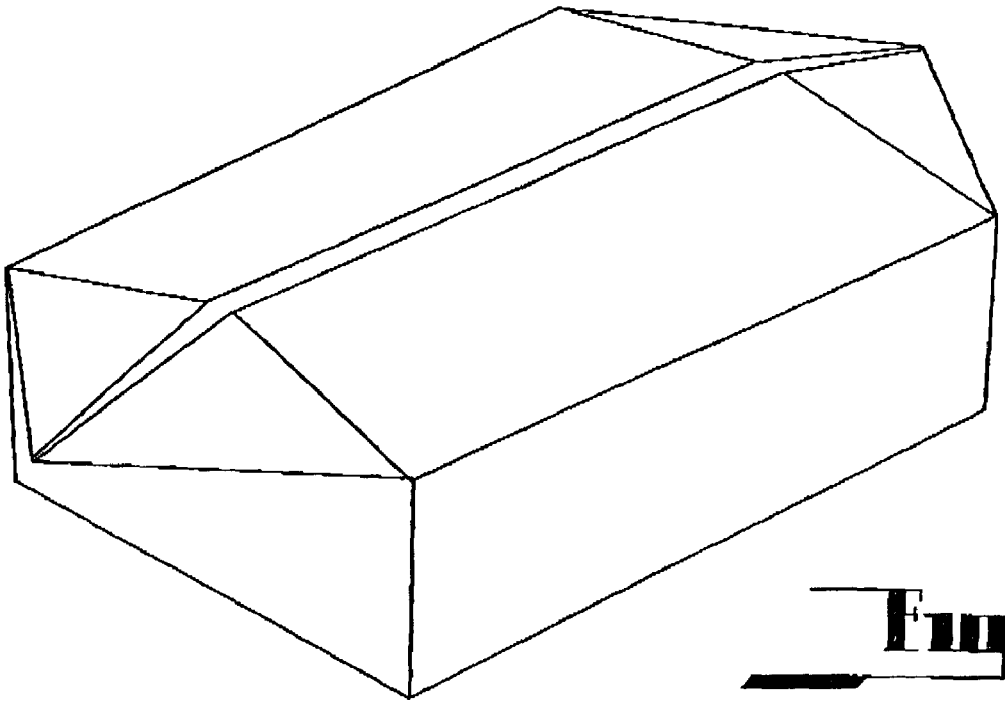
FIG. 19 is an isometric view of an erected carton formed from the blank of the fourth embodiment with the extension panels partially closed.
Figure 20:
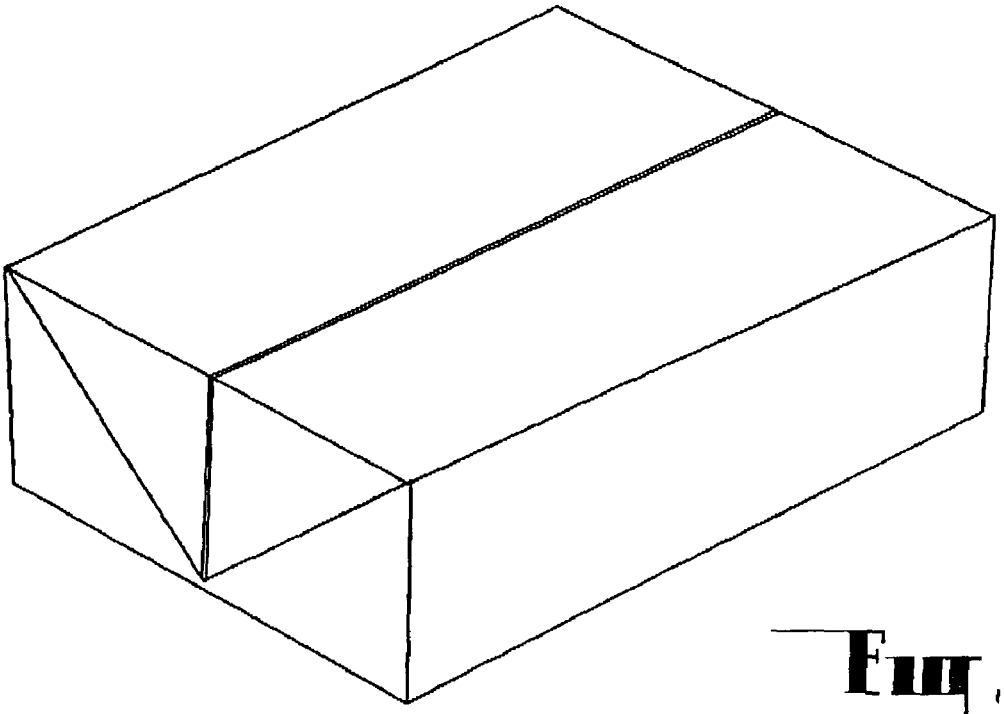
FIG. 20 is an isometric view of an erected carton formed from the blank of the fourth embodiment with the extension panels fully closed.
Figure 21:
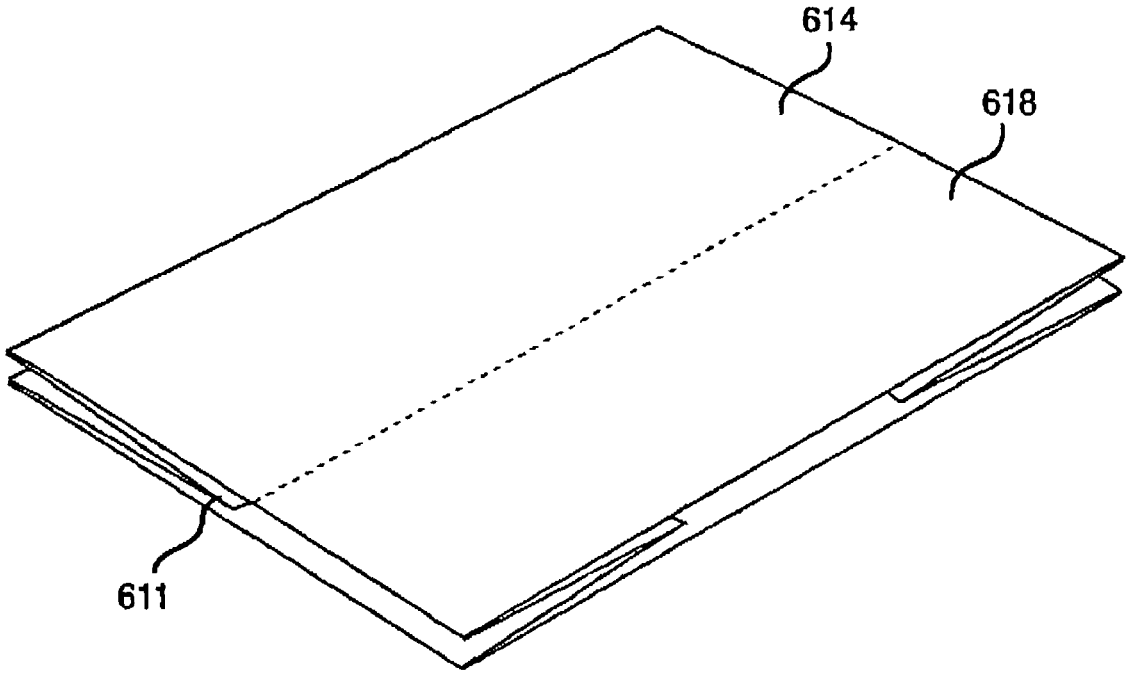
FIG. 21 is an isometric view of a folded carton formed from a blank according to the fourth embodiment.
Figure 22:
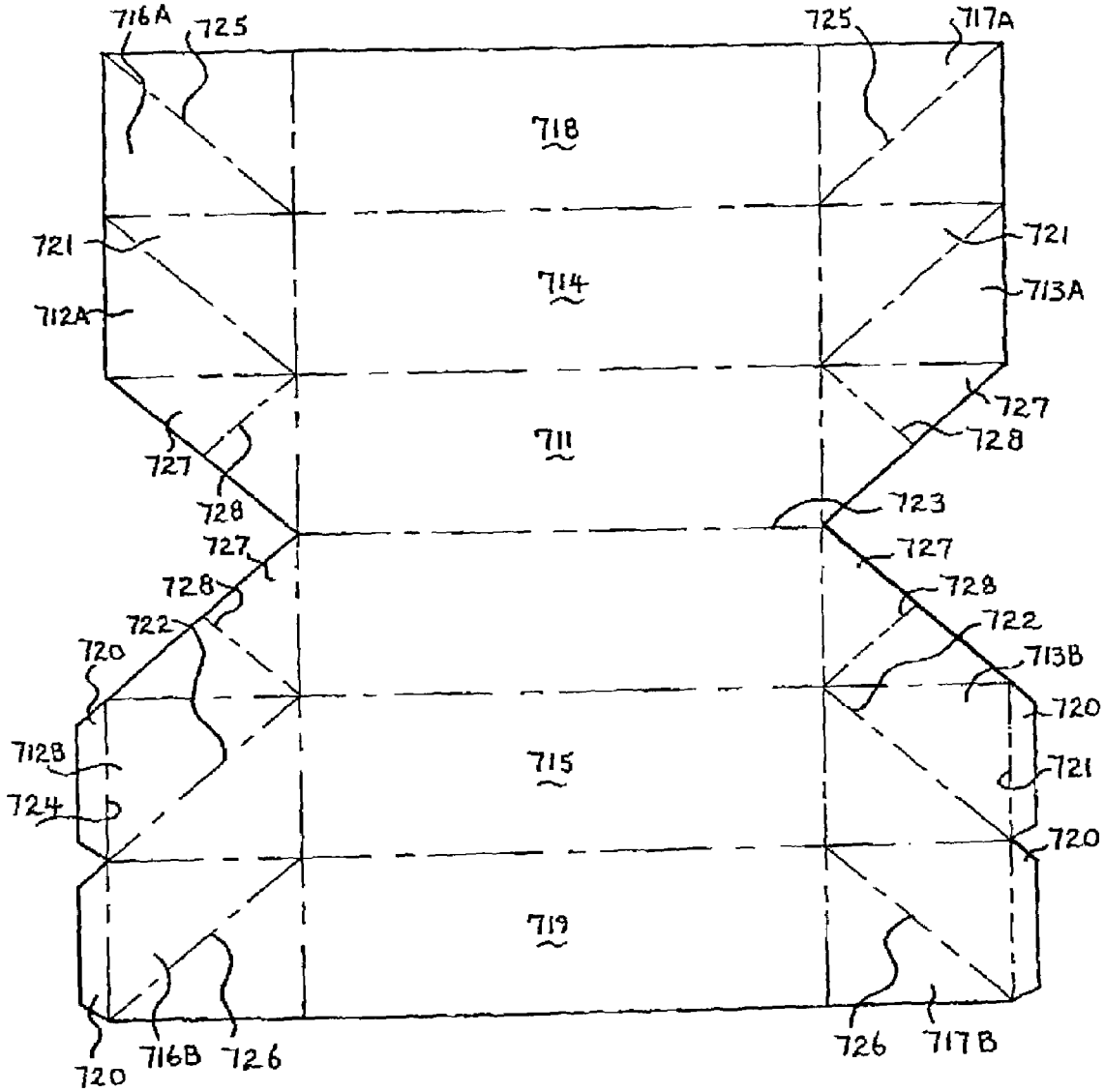
FIG. 22 is a plan view of a blank according to the fifth embodiment.

The fourth embodiment of FIGS. 17 to 21 comprises a carton which is of generally similar form to the first and second embodiment in terms of the configuration of the erected carton as shown at FIG. 18. The carton is formed from a blank where each of the side panels 614 and 615 and their extensions supports a portion of each end panel and their extensions which when the carton is erected combine to form the end panels. When the carton has been formed from the blank as shown at FIG. 18 it can be folded and collapsed in a similar manner to that of the first, second and third embodiment as shown at FIG. 21 and can be closed in a similar manner to that of the first and second embodiment as shown at FIGS. 19 and 20 with the same locking action as described in relation to the first embodiment.

Figure 23:
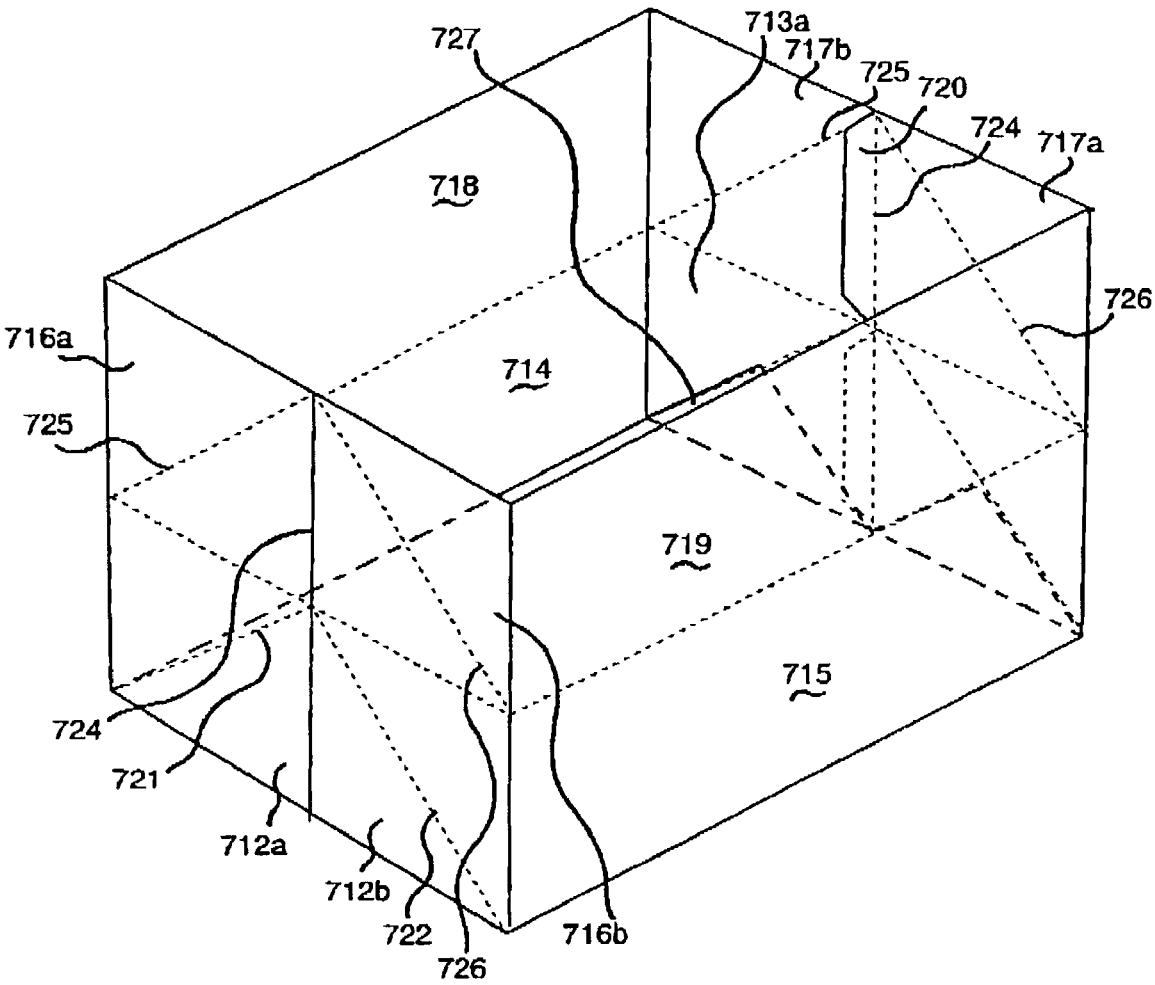
FIG. 23 is an isometric view of an erected carton formed from a blank according to the fifth embodiment with the extension panels open.
Figure 24:
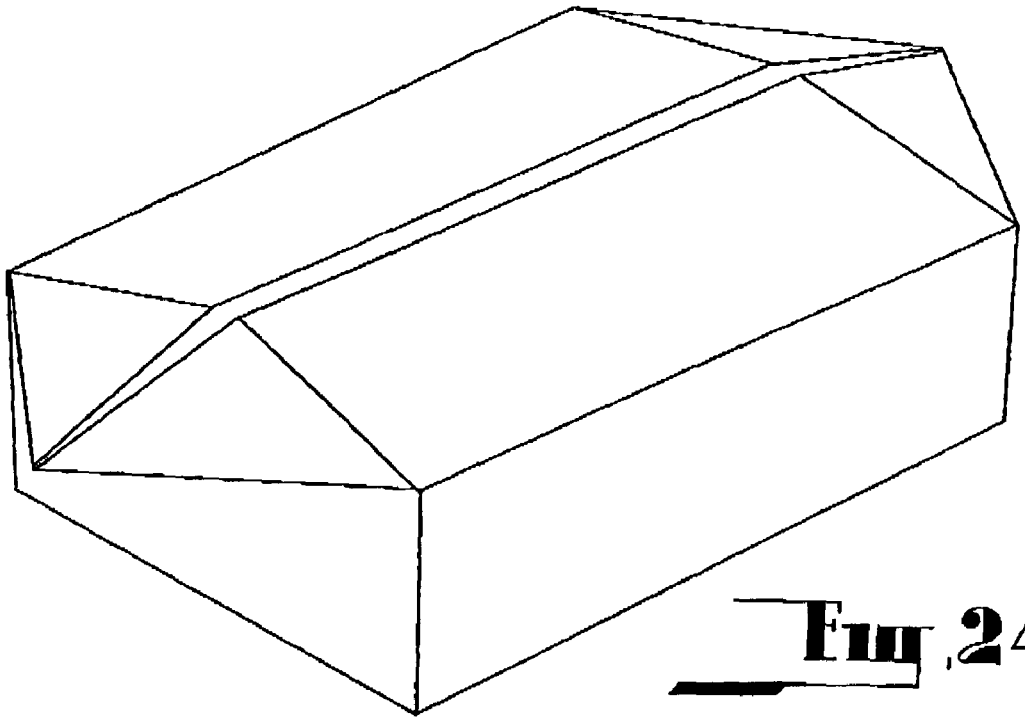
FIG. 24 is an isometric view of an erected carton formed from the blank of the fifth embodiment with the extension panels partially closed.
Figure 25:
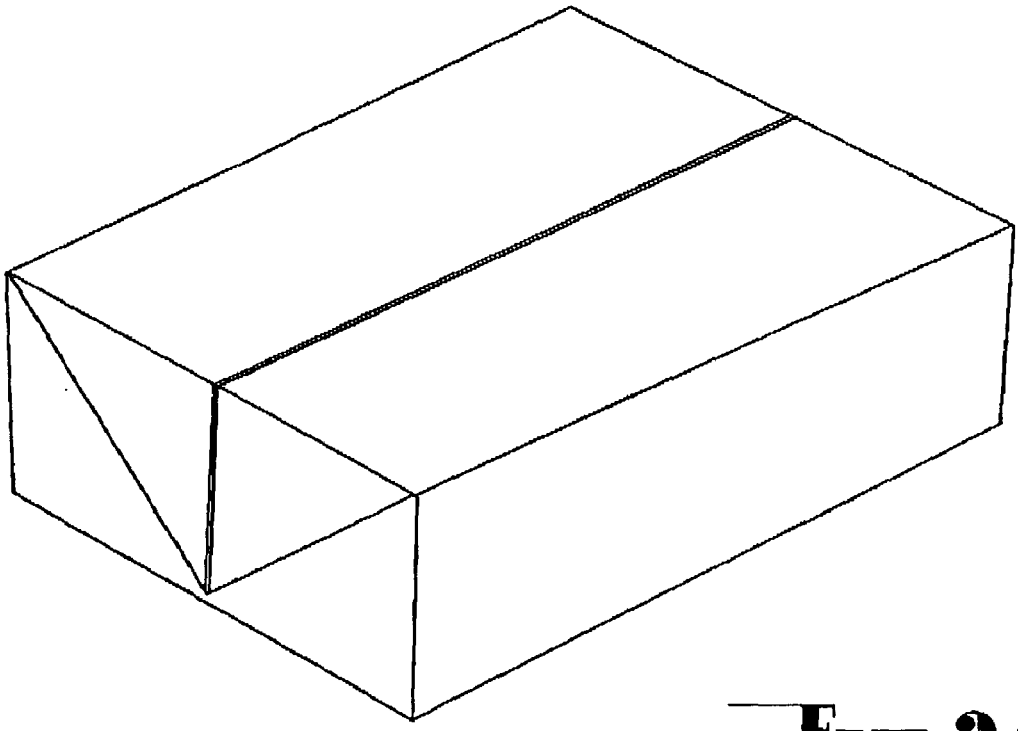
FIG. 25 is an isometric view of an erected carton formed form the blank of the fifth embodiment with the extension panels fully closed.
Figure 26:
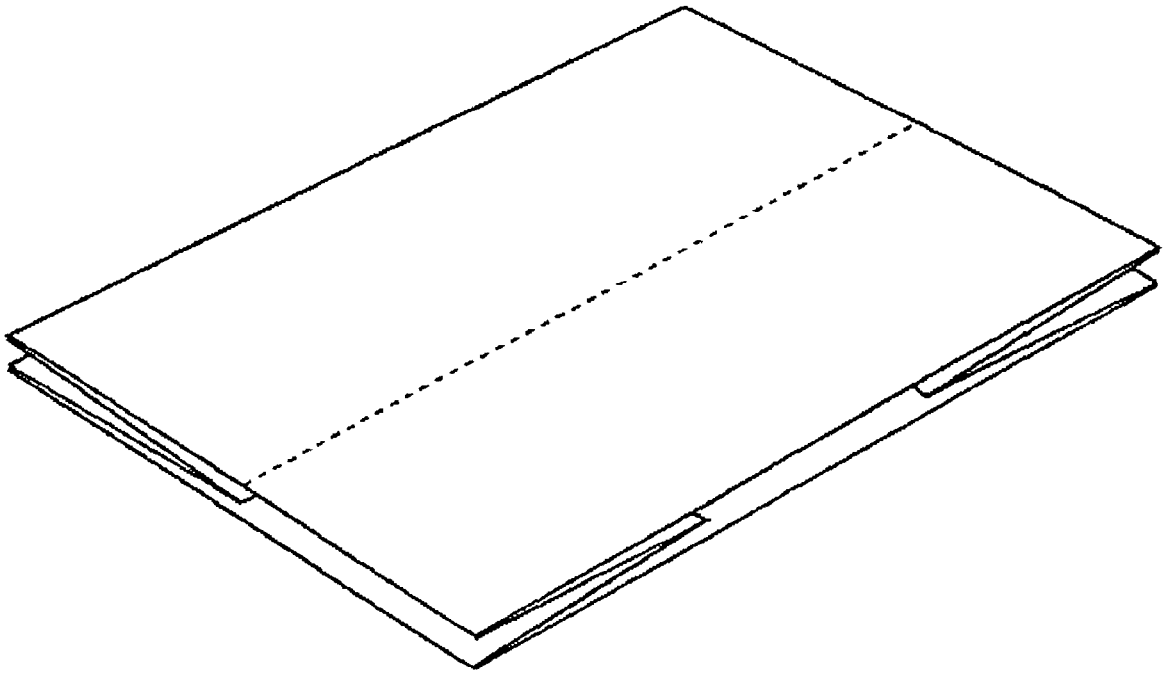
FIG. 26 is an isometric view of a folded carton formed from a blank according to the fifth embodiment.
Figure 27:
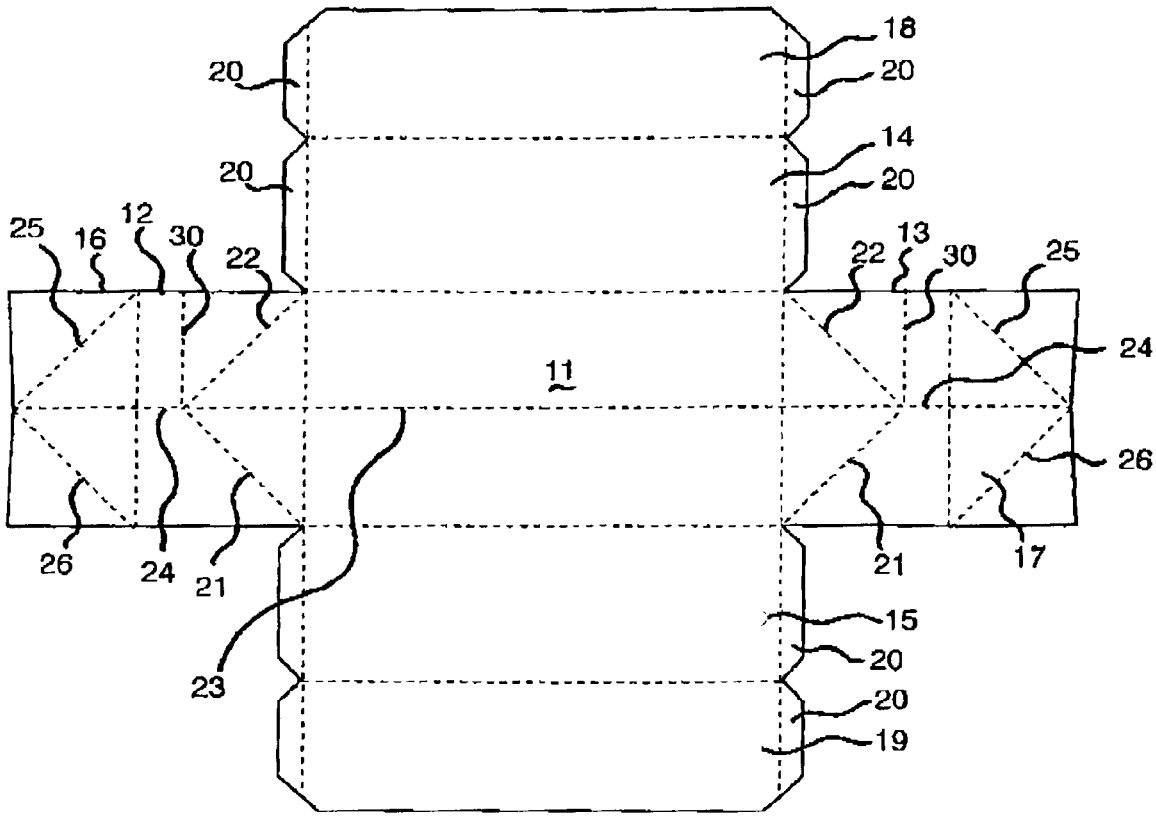
FIG. 27 is a plan view of a blank according to the sixth embodiment.

The fifth embodiment of FIGS. 22 to 26 is of a similar form to that of the third embodiment of FIGS. 17 to 21 with the exception that the adjacent edges of the portions of the end panels 712*a*, 712*b*, 713*a* and 713*b* and the floor panel 711 are interconnected by web members 727 having an edge which is at 45 degrees to the respective edges of the portion of the respective end panel and the floor panel. Each web 727 is provided with a third diagonal fold line 728 extending from the junction between the respective portion of the end panel and the floor panel and which bisects the angle therebetween. In formation of the carton the web panels 727 are folded inwardly as a result of the third diagonal fold line folding inwardly into the interior of the carton whereby on the carton being erected the folded web 727 lies against the end panel and is glued thereto. When the carton has been formed from the blank as shown at FIG. 23 it can be folded and collapsed in a similar manner to that of the first, second, third and fourth embodiment as shown at FIG. 26 and can be closed in a similar manner to that of the first and second embodiment as shown at FIGS. 24 and 25 with the same locking action as described in relation to the first embodiment.

The sixth embodiment of FIGS. 27 and 28*a* to 28*g* is of very similar form to the first embodiment as shown at FIGS. 1 to 6 and the same reference numerals have been used in respect of corresponding features. The only difference is that the sixth embodiment includes a transverse fold line 30 formed in each of the end panels 12 and 13 and which extends from the point of intersection of the first diagonal fold lines 21 and 22 to one side of each end panel 12 and 13. The transverse fold line facilitates the folding of the blank to form a carton. The steps involved in forming the carton are illustrated at FIGS. 28*a* to 28*g*.

Figure 28A:
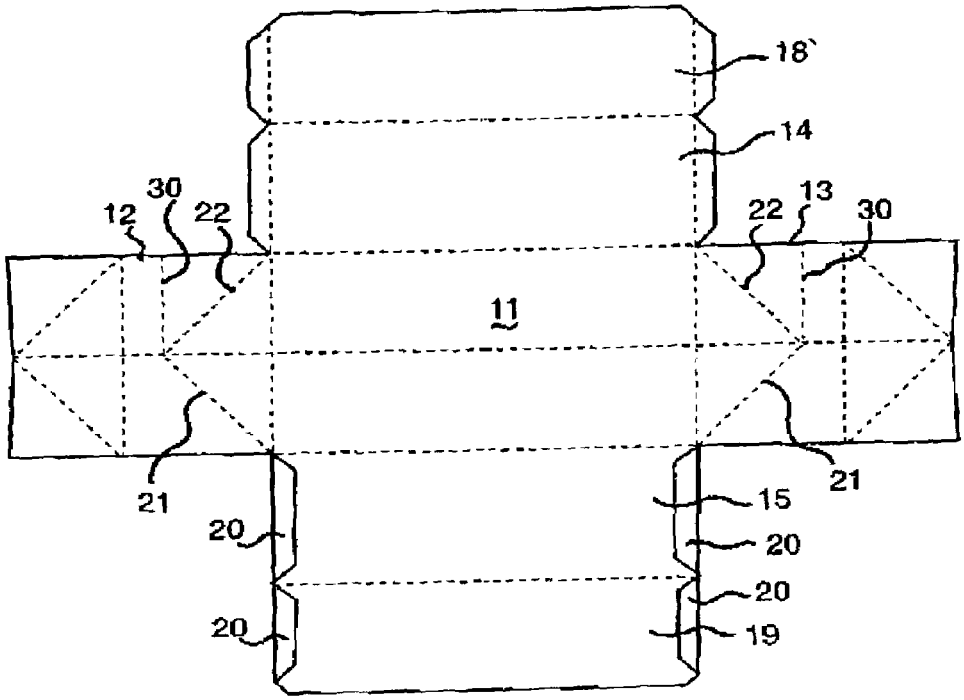
FIGS. 28*a* to 28*g* illustrate the assembly of a carton according to the sixth embodiment from the blank shown at FIG. 27.
Figure 28B:
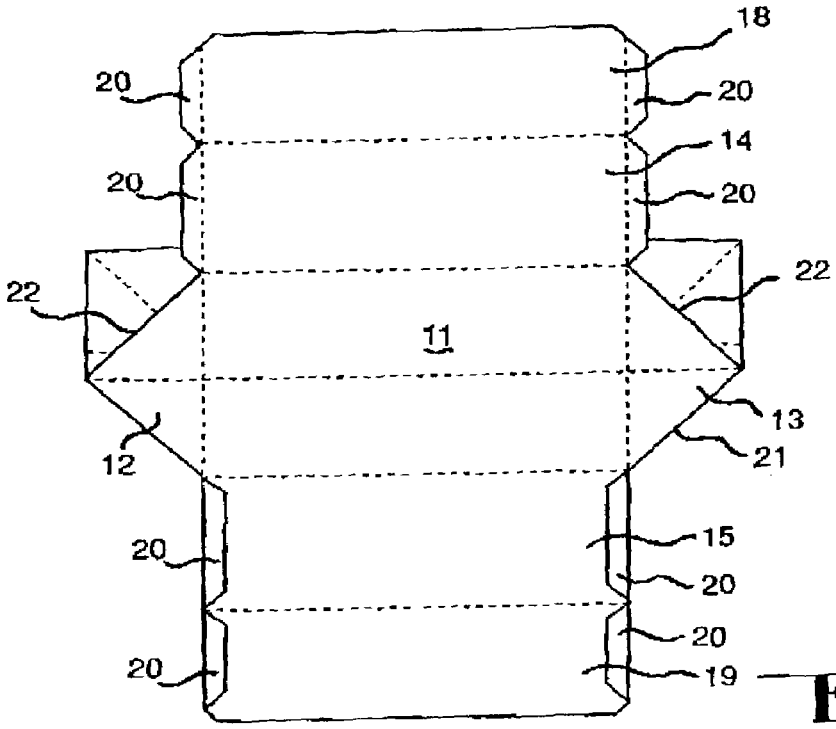
Figure 28C:
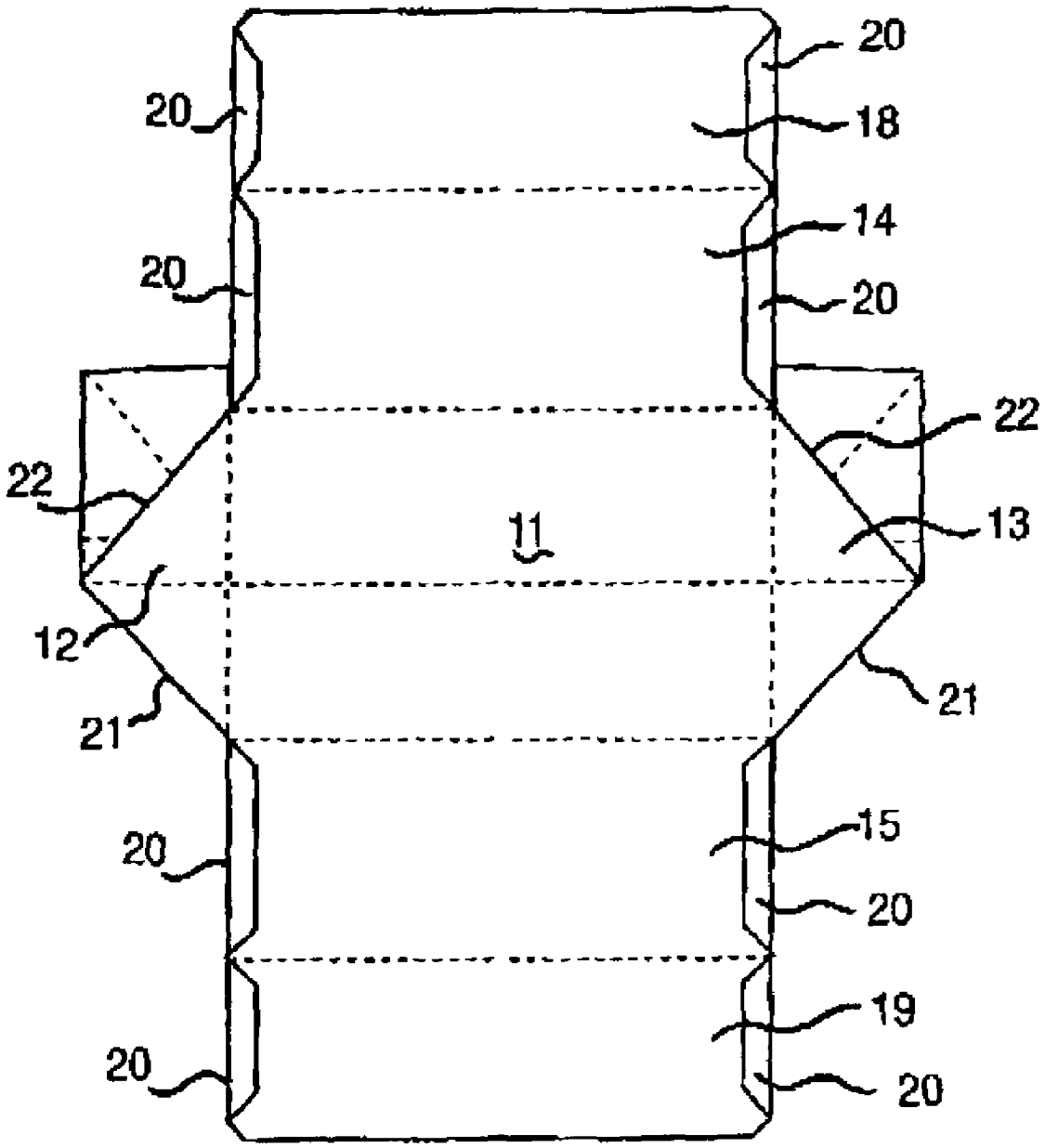
Figure 28D:
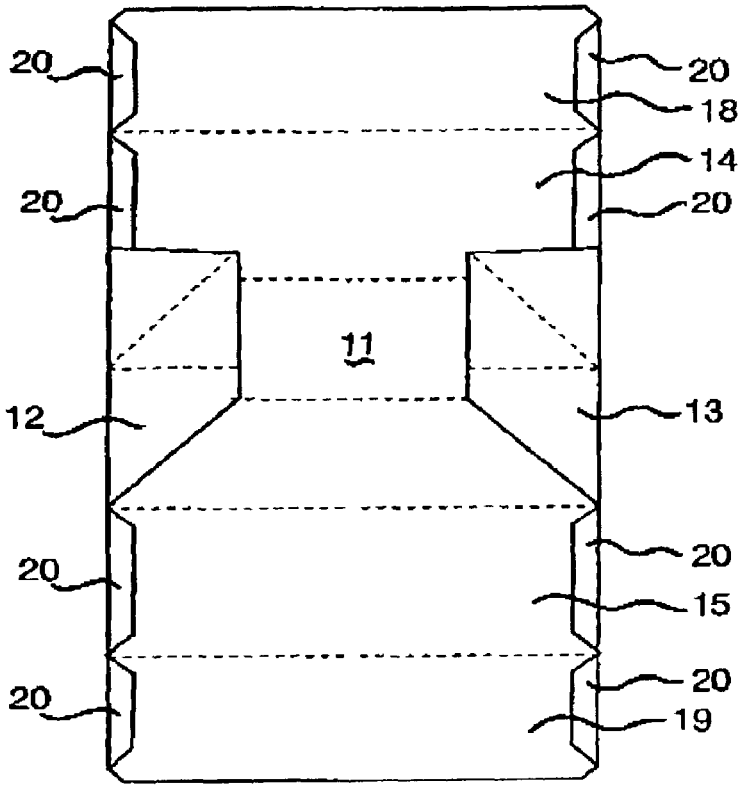
Figure 28E:
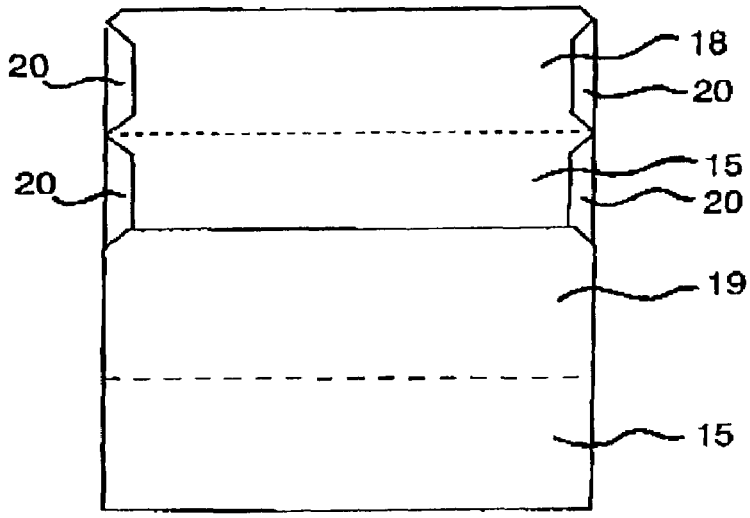
Figure 28F:
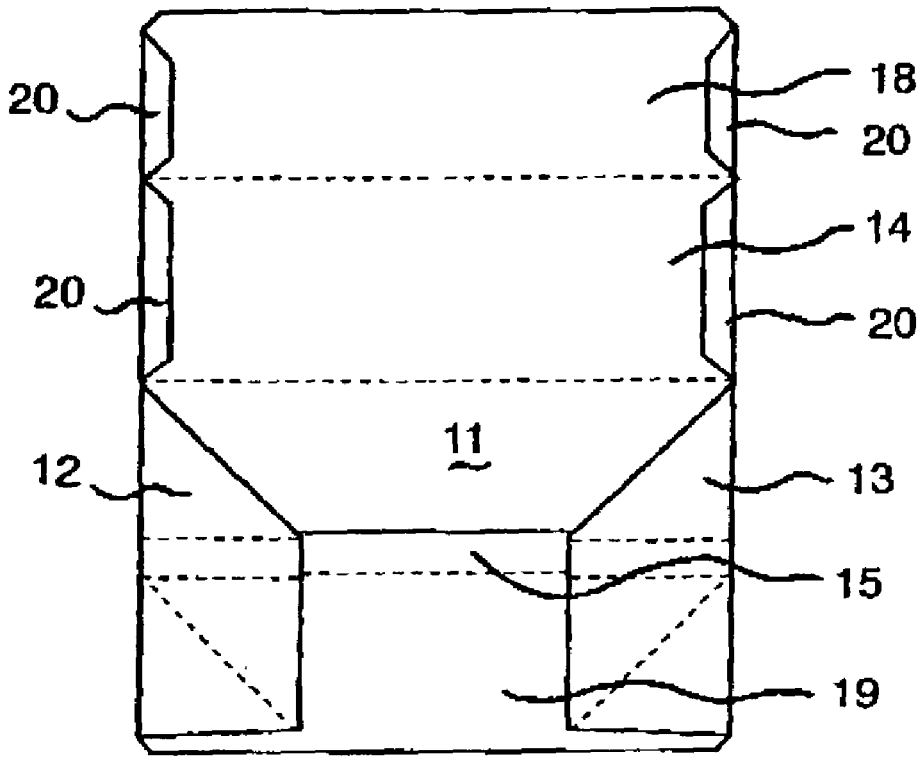
Figure 28G:
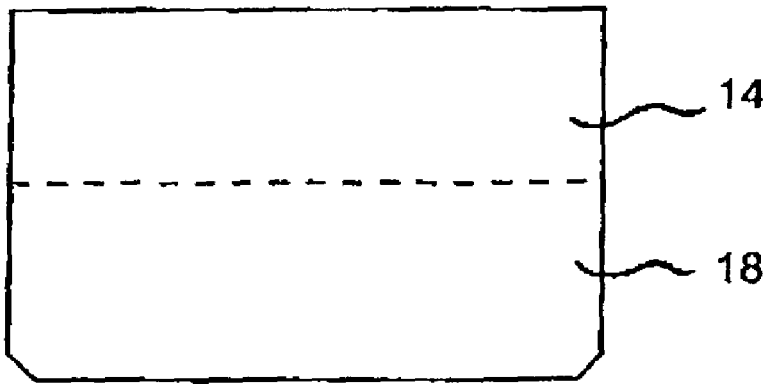

The first step involves folding the glue flaps 20 provided on the side panel 15 and extension panel 19 which are remote from the transverse fold line 30 inwardly such that they overlie the respective panel 15 and 19 respectively as shown at FIG. 28*a*. The second step involves folding each end panel 12 and 13 about the first diagonal folds lines 21 and 22 and simultaneously folding the end panel 12 and 13 about the transverse fold line 30 to cause the outer portion of each end panel to underlie the portion of the end panel defined by the first diagonals 21 and 22 as shown at FIG. 28*b*. The third step involves folding the glue flaps 20 provided on the side panel 14 and extension panel 18 which are proximate the transverse fold line 30, inwardly such that they overlie the respective panel 14 and 18 respectively as shown at FIG. 28*c*. The fourth step involves folding each end panel 12 and 13 about the junction with the floor panel 11 such that the end panels 12 and 13 in their entirety overlie the floor panel 11 as shown at FIG. 28*d*. The fifth step involves folding the side panel 15 which is remote from the transverse fold line 30 about the junction with the floor panel 11 after the exposed faces of the glue flaps 20 of that side panel and its extension panel 19 have been rendered such that they will adhere to the opposed faces of the end panels 12 and 13 as shown at FIG. 28*e*. The sixth step involves folding the blank as folded to that point in time about the central fold line 23 in the floor panel 11 as shown at FIG. 28*f*. The final step involves folding the side panel 14 which is proximate the transverse fold line 30 about the junction with the floor panel 11 after the exposed faces of the glue flaps 20 of that side panel and its extension panel 18 have been rendered such that they will adhere to the opposed faces of the end panels 12 and 13 as shown at FIG. 28*g*. The resultant folded blank will take the form as shown at FIG. 6 in relation to the first embodiment and can be opened to form an erected carton as shown at FIG. 3 in relation to the first embodiment and can be folded in the same manner as is described in regard to the first embodiment and as shown at FIGS. 4 and 5 with the same locking action as described in relation to the first embodiment.

The above folding sequence in relation to the sixth embodiment is given by way of example only. The folding sequence can vary depending upon the nature of the folding facilities that are available.

Throughout the specification, unless the context requires otherwise, the word "comprise" or variations such as "comprises" or "comprising", will be understood to imply the inclusion of a stated integer or group of integers but not the exclusion of any other integer or group of integers.

It should be appreciated that the scope of the present invention need not be limited to the particular scope of the embodiments described above.

What is claimed is:

1. A collapsible carton which is formed from a blank which when formed from the blank is capable of being folded between a folded flat condition and an erect condition whereby when in the erect condition the carton comprises:

a floor panel;

two opposed end panels; and two opposed side panels to define a generally rectangular prismatic shaped space, wherein the end panels and the side panels have substantially the same height, wherein a floor is formed from the floor panel and the end panels and the side panels, the floor having a perimeter formed from a junction between the floor panel and each of the side panels and each of the end panels, the junction being liquid-tight, wherein the end panels each have a pair of first diagonal fold lines extending from the junction between the sides of the floor and the sides of the respective end panel and converging to terminate at a transverse central axis of the end panel, the pair of first diagonal fold lines being substantially perpendicular to each other, the end panels have a height being equal to or greater than the termination of the first diagonal fold lines, wherein the floor panel is provided with a first central fold line which is substantially centrally located and which extends between the end panels and is adapted to permit the floor panel to fold inwardly into the space about the first central fold line while the first diagonal fold lines fold, wherein the end panels have a second central fold line extending centrally from the floor panel to an opposed edge of the end panels, wherein each end panel and each side panel is formed with an integral extension panel-being of substantially the same height as its respective end panel or side panel, wherein in the erected carton an abutting edge of adjacent extension panels are defined by a closed fold line, wherein in the blank each side panel supports a portion of each end panel whereby the adjacent portions of the end panels co-operate to define at least one of the end panels when the blank is folded to an erect condition, wherein the extension panels of each end panel each have a pair of second diagonal fold lines extending between the junction between the end panel and the extension panel at the sides thereof and converging to terminate at the junction of the second diagonal fold lines with the outer edge of the extension panels, whereby on the erection of the carton the extension panels of each end panel fold about the second diagonal fold lines and the junction with the end panels to an intermediate position where the extension panels of the side panels fold over the space to close the space and lie substantially parallel to the floor panel, and wherein the extension panels of the end panels are foldable about their junction with their respective end panels to lie in a self locked position substantially parallel to and adjacent their respective end panels on an outside of the space in a self locked position by a biasing force is applied to the extension panels of the end panels in a direction of their respective end panels.

2. The carton according to claim 1 wherein the floor panel has a perimeter identical to the perimeter of the floor.

3. A collapsible carton which is formed from a blank which when formed from the blank is capable of being folded between a folded flat condition and an erect condition whereby when in the erect condition the carton comprises:

a floor panel;

two opposed end panels; and two opposed side panels to define a generally rectangular prismatic shaped space, wherein the end panels and the side panels have substantially the same height, wherein a floor is formed from the floor panel and the end panels and side panels, the floor having a perimeter formed from a junction between the floor panel and each of the side panels and each of the end panels, the junction being liquid-tight, wherein the end panels each have a pair of first diagonal fold lines extending from the junction between the sides of the floor and the sides of the respective end panel and converging to terminate at a transverse central axis of the end panel, the pair of first diagonal fold lines being substantially perpendicular to each other, the end panels have a height being equal to or greater than the termination of the first diagonal fold lines, wherein the floor panel is provided with a first central fold line which is substantially centrally located and which extends between the end panels, and is adapted to permit the floor panel to fold inwardly into the space about the first central fold line while the first diagonal fold lines fold, wherein the end panels have a second central fold line extending centrally from the floor panel to an opposed edge of the end panels, wherein each end panel and each side panel is formed with an integral extension panel, being of substantially the same height as its respective end panel or side panel, wherein in the erected carton an abutting edge of adjacent extension panels are defined by a closed fold line, wherein the extension panels of each end panel each have a pair of second diagonal fold lines extending between the junction between the end panel and the extension panel at the sides thereof and converging to terminate at the junction of the second diagonal fold lines with the outer edge of the extension panels, whereby on the erection of the carton the extension panels of each end panel fold about the second diagonal fold lines and the junction with the end panels to an intermediate position where the extension panels of the side panels fold over the space to close the space and lie substantially parallel to the floor panel, and wherein the extension panels of the end panels are foldable about their junction with their respective end panels to lie a self locked position substantially parallel to and adjacent their respective end panels on an outside of the space in a self locked position by a biasing force applied to the extension panels of the end panels in a direction of their respective end panels, said first end portion and said second end portion cooperate to define said end panel in the erected condition;

wherein, in the blank, each end panel comprises a first end panel portion and a second end panel portion that extend laterally from the same side of respective side panels, and each end extension panel comprises a first end extension portion and a second end extension portion that extend laterally from the same side of respective side extension panels.

4. The carton according to claim 3, wherein in the blank, each of the first end portions and second end portions is provided with one of the first diagonal fold lines.

5. The carton according to claim 4, wherein in the blank, each of the first end extension portions and second end extension portions is provided with one of the second diagonal fold lines.

6. The carton according to claim 3 wherein the floor panel has a perimeter identical to the perimeter of the floor.

* * * * *